United States Patent [19]

Haneda et al.

[11] Patent Number: 4,557,992

[45] Date of Patent: Dec. 10, 1985

[54] DEVELOPING METHOD

[75] Inventors: Satoshi Haneda; Seiichiro Hiratsuka, both of Hachioji, Japan

[73] Assignee: Konishiroku Photo Industry Co., Ltd., Tokyo, Japan

[21] Appl. No.: 593,352

[22] Filed: Mar. 26, 1984

[51] Int. Cl.[4] ..... G03G 15/09

[52] U.S. Cl. ..... 430/122; 118/657; 118/658; 355/14 D; 430/120

[58] Field of Search ..... 430/120, 122, 102; 118/657, 658; 355/14 D

[56] References Cited

U.S. PATENT DOCUMENTS 4,336,318 6/1982 Fukumoto et al. ..... 430/122 X 4,450,220 5/1984 Haneda et al. ..... 430/120 X

*Primary Examiner*—John D. Welsh

*Attorney, Agent, or Firm*—James E. Nilles; Thomas F. Kirby

[57] ABSTRACT

A developing method wherein a developer layer formed on a developer feeding carrier is conveyed, into an oscillating electric field, and an electrostatic latent image on an image retainer is developed by the developer of the developer layer inside the oscillating electric field. The developer has carrier particles and toner particles and the average particle size of the carrier particles is from 5 to 50 μm. The average particle size of the toner particles is up to 20 μm. The carrier particle and the toner particle are sphered.

17 Claims, 18 Drawing Figures

DEVELOPING METHOD

BACKGROUND OF THE INVENTION

1. Field of the Invention

This invention relates to a developing method which changes an electrostatic image formed on an image retainer of an electrostatic recording apparatus such as an electrophotographic reproducing machine into a visible image, or to a developing method which changes a magnetic image into a visible image.

2. Description of the Prior Art

First of all, the reproducing process in an electrophotographic reproducing machine will be briefly described as an example.

In an electrophotographic reproducing machine of a document glass plate type, for example, a document to be reproduced is first placed on a document glass plate, and a reproduction button is then depressed so that an exposure lamp exposes and scans the document while illuminating it and keeping a predetermined relation with an optical system having reflection mirror and the like. The reflected ray of light in accordance with the density of the document is radiated onto an image retainer (photosensitive drum), which is uniformly charged electrically, through the optical system, forming an electrostatic image on the photosensitive drum. This electrostatic image is developed by a developing machine into a visible image by a toner corresponding to the density of the document.

On the other hand, a reproduction paper (transfer material) is sent from a paper feeder means in synchronism with the rotation of the photosensitive drum, is the registered to be in agreement with the toner image formed on the photosensitive member, and is thereafter transferred onto the reproduction paper by a transfer electrode. After the toner image is thus transferred, the reproduction paper is separated from the photosensitive drum and is sent to a roller fixing device. The roller fixing device consists of two rollers at least one of which is heated, and heats and fixes the toner image transferred onto the reproduction paper. Thereafter, the reproduction paper is discharged outside the main frame of the reproducing machine.

Developers used for the process described above include a two-component system developer and a one-component system developer. The two-component system consists of a toner as tinting particles and a carrier necessary for electrically charging the toner and transferring it to a developing unit, while the latter consists principally of tinting particles as a unitary structure of a resin and a magnetic substance.

A magnetic brush developing method is generally known as a developing method using a developer containing a magnetic substance.

Next, this magnetic brush developing method will be described briefly.

A developer transfer retainer or support incorporating therein a fixed or rotatable magnetic roller is disposed in the proximity of a photosensitive member. The developer is brought into sufficient contact with part of this developer transfer support. When either one, or both, of the magnetic roller and the developer transfer support rotate, the ear of the developer is formed on the peripheral surface of a sleeve, and this developer is transferred to a developing unit, where it is brought into contact with the photosensitive member. The toner particles are attracted to the charged portion of the photosensitive member, and a visible image by the toner particles is formed on the photosensitive member.

The magnetic brush developing method using the one-component system developer involves the problem that the toner particles can not be easily charged due to friction, and the aggregation of the toner particles is likely to occur. For this reason, the toner particles are not sufficiently attracted to the charged portion of the photosensitive member from time to time. This problem does not occur when the two-component system developer is used, the magnetic brush can be stably formed and the friction property of the magnetic brush with the photosensitive member is excellent. In addition, the brush exhibits a sufficient cleaning effect when used for the cleaning purpose. Accordingly, the two-component system developer has gained a wide application, although the management of the quantity of the toner particles with respect to the carrier particles is necessary. This developing method generally uses a developer consisting of magnetic carrier particles having a particle size of between several dozens to several hundreds of microns and non-magnetic toner particles having a particle size of about a dozen microns. Since the toner particles as well as the carrier particles are rather coarse, this method is not free from the problem that a high quality picture reproducing delicate lines or dots or density can not be obtained easily. In order to obtain a high quality picture by this developing methods, various attempts have been made in the past such as resin coating of the carrier particles, an improvement of a magnetic substance in the developer transfer support, the application of a bias voltage to the developer transfer support, and so forth, but these methods have not yet been entirely stable and been able to provide a sufficiently satisfactory picture. It is therefore believed that the particle sizes of the toner and carrier particles must be rather reduced, in order to obtain a high quality picture.

If the toner particles have a particle size of up to 20 μm and particularly up to 10 μm, the following problems occur.

(1) The influence of van der Waals forces appears to the Coulomb force at the time of development and so-called "fog" in which the toner particles are deposited to the base portion of the background of the image occurs. This fog can not be prevented easily even by the application of a D.C. bias voltage to the developer transfer support.

(2) Control of frictional charge of the toner particles becomes difficult, and the aggregation of the toner particles is likely to occur. If the particle size of the toner particles is further reduced;

(3) The carrier particles attach to the electrostatic image portion of the image retainer.

It is believed that these phenomena occur because the force of the magnetic bias drops, and the carrier particles are deposited to the image retainer together with the toner particles. When the bias voltage is increased, the carrier particles attach also to the base portion of the background of the image.

When the particle size is reduce, the undesirable side-reactions such as described above become remarkable, and a clear image can not be obtained. For this reason, it has been difficult to reduce practically the particle sizes of the toner and carrier particles.

SUMMARY OF THE INVENTION

The present invention is directed to provide a novel developing method which is free from the problems described above even when a developer consisting of fine carrier particles, particularly preferably when a developer consisting of a mixture of magnetic carrier particles and toner particles, is used.

The object of the present invention described above can be accomplished by a developing method which comprises the steps of supplying a developer containing carrier particles and toner particles to a developer transfer support to form a developer layer, conveying the developer layer into an oscillating electric field, and developing an latent image on an image support by the developer inside the oscillating electric field.

In developing an image formed on an image retainer by supplying a developer consisting of carrier particles, particularly preferably a developer consisting essentially of a mixture of magnetic carrier particles and toner particles, to a developer transfer support and oscillating at least the toner particles in the developer between the developer transfer support and the image retainer opposing the developer transfer support by use of an oscillator, the object of the invention described above can be accomplished by a developing method in which the average particle size of the carrier particles is from 5 to 50 μm (preferably, up to 30 μm) and the average particle size of the toner particles is up to 20 μm (preferably, up to 10 μm). Here, the term "average particle size" means the average of the diameters of the particles (number average of the major axis and the minor axis).

It is another object of the present invention to provide a developing method which does not cause the problems described above even when a developer consisting of fine toner particles and/or fine carrier particles is used. In other words, the present invention is directed to provide a developing method which does not cause the above-mentioned problems (1) and (2) even when toner particles having an average particle size of up to 20 μm and further, up to 10 μm are used, which does not cause the above-mentioned problem (3) even when the average particle size of carrier particles is up to 50 μm and further, up to 30 μm, and hence which can obtain a clear picture of a high quality by reproducing delicate lines or dots or density with a high level of fidelity.

In a method of developing a latent image formed on an image retainer by supplying a two-component system developer consisting of magnetic carrier particles and toner particles onto the surface of a developer transfer support to form a layer of the developer, placing the developer layer on the developer transfer support into an oscillating electric field and thus developing the latent image on the image retainer, the object of the invention described above can be accomplished by a developing method in which the magnetic carrier particles are sphered.

In a method of developing an image formed on an image retainer by supplying a two-component system developer consisting of magnetic carrier particles and toner particles onto the surface of a developer transfer support, placing the two-component system developer layer formed on the surface of the developer transfer support inside an oscillating electric field and thus developing the image on the surface of the image retainer, the object of the present invention described above can be accomplished by a developing method which uses spherical toner particles as the toner particles described above.

In a method of developing an image on the surface of an image retainer by forming a layer of a two-component system developer consisting of magnetic carrier particles and toner particles on the surface of a developer transfer support, and developing the image on the image support by the developer on the surface of the developer transfer support, the object of the present invention described above can also be accomplished by a developing method which uses the magnetic carrier particles consisting of magnetic particles and thermoplastic resin particles, and which effects development inside an oscillating electric field.

It is still another object of the present invention to provide a developing method of an electrostatic latent image and a magnetic latent image, which makes it possible to easily fix toner particles onto recording paper, can prevent filming of the toner particles to carrier particles, which can use toners and carriers in the fine powder form, and which can reproduce delicate lines and dots or density with a high level of fidelity.

In a method of developing an image formed on an image retainer by forming a layer of a two-component system developer consisting of toner particles and magnetic carrier particles, on the surface of a developer transfer support, and developing the image on the image retainer by use of the developer layer, the object of the invention described above can be accomplished by a developing method which uses toner particles for pressure-fixing as the toner particles described above, and which effects development inside an oscillating electric field.

It is still another object of the present invention to provide a method of developing an electrostatic image which makes it possible to use fine toners and fine carriers for a two-component system developer, which prevents the occurrence of fog and the deposition of the carrier particles onto the surface of the image retainer, and which insures the development of a clear high quality picture.

In a method of developing a latent image formed on an image retainer by forming a layer of a developer consisting of toner particles and magnetic carrier particles on the surface of a developer transfer support and developing the latent image on the image retainer by the use of the developer layer thus formed, the object of the present invention described above can be accomplished by a developing method which keeps the developer layer on the developer transfer support out of contact with the image retainer, disposes a control electrode in the gap between them so as to control the projection of the toner particles from the developer layer to the image retainer, applies an A.C. voltage component to either one of the control electrode and the developer transfer support, and effects development inside the resulting oscillating electric field.

These and other objects and features of the present invention will become more apparent from the following detailed description thereof to be taken in conjunction with the accompanying drawings.

DESCRIPTION OF THE PREFERRED EMBODIMENTS

Hereinafter, some preferred embodiments of the invention will be described in detail with reference to the accompanying drawings.

Figure 1:
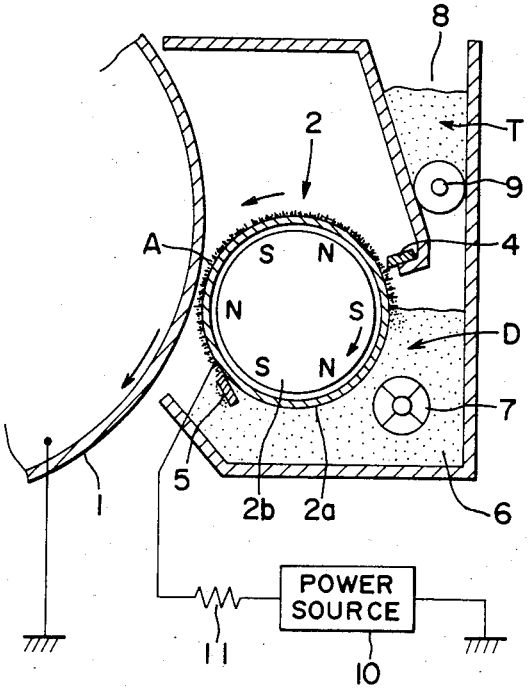
FIGS. 1, 2, 3, 16, 17 and 18 schematically illustrate developing apparatuses used for the embodiments of the present invention, respectively.

FIG. 1 illustrates schematically a developing apparatus used for the developing method in one embodiment of the present invention.

An electrostatic latent image is formed on the surface of a drum-like image retainer 1 which is constituted by a photosensitive member such as Se, by a charging and exposing apparatus (not shown). The image retainer 1 is rotated in the direction indicated by arrow in the drawing. A developer transfer support 2 is disposed in the proximity of the image retainer 1, and consists of a sleeve 2*a* made of a non-magnetic material such as Al and a magnetic roller 2*b* equipped with a plurality of magnetic poles in its circumferential direction. The magnetic poles of the magnet roller 2*b* are generally magnetized to a flux density of between 500 and 1,500 Gauss. To transfer a developer D from a developer stay 6 to a developing unit A, the sleeve 2*a* is kept fixed while the magnet roller 2*b* is rotated. Alternatively, the magnet roller 2*b* may be kept fixed with the sleeve being rotatable. Still alternatively, both magnet roller and sleeve may be rotated. However, if the sleeve 2*a* is rotated, the transfer direction of the developer D is the same as the rotating direction of the sleeve 2*a*, but if the magnetic roller 2*b* is rotated, the transfer direction is opposite to the rotating direction. In FIG. 1, the magnet roller 2*b* is rotated clockwise while the sleeve 2*a* is rotated counter-clockwise, so that the developer D is transferred counter-clockwise.

Figure 2:
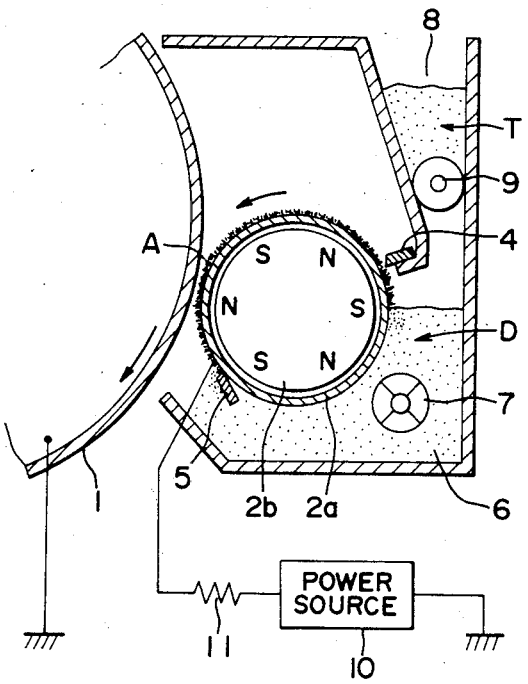
Figure 3:
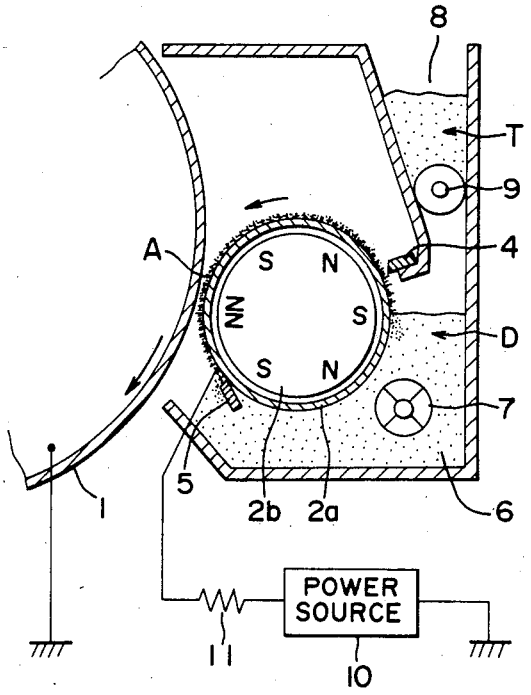

In FIG. 2, the magnet roller 2*b* is kept fixed while the sleeve 2*a* is rotated counter-clockwise. In this case, the flux density of the magnetic pole opposing the image retainer 1 is kept greater than that of the other flux density. To further increase the flux density of the pole opposing the image retainer 1, two poles of the same or different polarities may be brought close to each other, an shown in FIG. 3.

The height of the developer D, that is being transferred on the peripheral surface of the sleeve 2*a*, is limited by a regulation blade 4. The developer D then reaches the developing unit A. Part of the developer is attracted onto the image retainer 1 while the rest are transferred on the peripheral surface of the sleeve 2*a* in the direction represented by arrow in the drawing, and is thereafter removed from the peripheral surface of the sleeve 2*a* by a cleaning blade 5. An agitation screw 7 stirs the developer D inside the developer stay 6 and makes uniform the proportion between the toner particles and the carrier particles.

When development is effected, large quantities of the toner particles in the developer D is used and consumed. To supply the toner particles T, a toner hopper 8 is disposed, and a feed roller 9 having recesses on its surface is rotated so as to supply the toner particles T to the developer stay 6 to supplement the toner particles that are consumed. This power source 10 serves at least as an oscillating electric field generator which oscillates the developer D at the developing area A between the sleeve 2*a* and the image retainer. A power source 10 is also disposed in order to apply a bias voltage to the sleeve 2*a* through a protective resistor 11.

The noteworthy construction of the electrostatic image developing method described above is that the magnetic carrier particles have an average particle size of between 5 to 50 μm, and the toner particles have an average particle size of up to 20 μm.

In the conventional magnetic brush developing method, the developer D is electrically charged by friction, and is attracted by the Coulomb force with the charge portion of the image retainer 1. Accordingly, there is an inherent limit to the reduction of the particle size of the developer to sufficiently charge the developer D for development.

This problem does not occur in this embodiment even if the developer consists of fine particles.

Since the present invention uses an oscillating electric field, the particles of the developer D oscillate between the sleeve 2*a* and the image retainer, so that a visible image by the developer D can be formed on the image retainer 1 even if the developer D does not come into sufficient contact with the image retainer 1 as required in the conventional magnetic brush developing method.

To prevent fog, the thickness of the developer layer is preferably smaller than the spacing between the image retainer and the sleeve. The moving direction of the developer may be the same or opposite to that of the image retainer and its moving speed is preferably higher than that of the latter, though this is not particularly limitative.

Accordingly, the fine carrier particles and fine toner particles, that have not been usable in the conventional magnetic brush developing method, can now be used in the present invention.

If the particle size of the carrier particles used in the present invention is below 5 μm, especially, below 4 μm magnetization becomes too weak, and if it exceeds 50 μm, on the other hand, the picture quantity can not be improved and break-down and discharge are likely to occur, so that a high voltage can not be applied. The particle size of the toner particles below 1 μm, can not easily peel from the carrier even by the application of oscillation, and if it exceeds 20 μm, the resolution of the picture will drop. In view of the above, the toner particle size is preferably from 0.5 to 20 μm, and more preferably from 1 to 20 μm. The average charge quantity of the toner in this instance is preferably more than 1 μc/g, and much more preferably from 3 to 300 μc/g, and particularly preferably from 10 to 100 μc/g. (Aforesaid average charge quantity is measured by Blow-off method.)

Since a D.C. voltage for preventing the fog and an oscillating electric field for oscillating the developer D are applied between the image retainer 1 and the sleeve 2*a*, the spacing between them becomes a problem. If the spacing is too narrow, discharge occurs between them so that the image retainer is damaged and the transfer of the developer D passing between them is prevented. If the spacing is too wide, on the contrary, the effect of the opposing electrode will drop, recording having a sufficient developing density can not be obtained and the edge effect becomes high. A satisfactory result can be obtained if the spacing between them is up to 2,000 μm, particularly from dozens of microns to 1,000 μm.

The D.C. voltage of 50 to 500 V is applied as the D.C. bias voltage for preventing the fog in order to keep it at a higher potential than the non-image portion. The alternating current of 100 Hz to 10 KHz, preferably 1 KHz to 5 KHz, is used to oscillate the developer D. The D.C. voltage may be lower than the above if the toner has magnetism. When inversion development is effected, a higher D.C. voltage is of course applied. The A.C. voltage depends upon the frequency. The higher the voltage, the more vigorous becomes the oscillation of the developer D, but more likely becomes the occurrence of the fog and the discharge. If the frequency becomes higher, the developer can not follow up the change, so that the density and clearness of the development, and hence the picture quality, will drop.

The conventional magnetic carrier particles can be used as the carrier particles in the present invention, apart from their average particle size. Examples of the carrier particles include ferromagnetic or magnetic particles of iron, chromium, nickel, cobalt and their compounds or alloys as represented by triiron tetraoxide, γ-ferric oxide, chromium dioxide, manganese oxide, ferrite, manganese-copper type alloys, and the like; and insulating particles obtained by coating the surface of the particles of the materials described above by resins such as styrene type resins, vinyl type resins, ethyl type resins, rosin modified resins, acrylic type resins, polyamide resins, epoxy resins, polyester resins, and the like, or by aliphatic acid wax such as palcitinic acid, stearic acid, and the like. Among them, insulating magnetic particles having a resistivity of at least $10^8$ Ohm-cm are preferred, more preferable at least $10^{13}$ Ohm-cm and particularly those having a resistivity of at least $10^{14}$ Ohm-cm. If the resistivity is low, the charge is injected into the carrier particles when the bias voltage is applied to the developer transfer support, whereby the carrier particles are likely to attach to the surface of the image retainer, and the bias voltage can not be applied sufficiently.

The resistivity is determined in the following manner. After the particles are placed into a vessel having a cross-sectional area of 0.50 $cm^2$ and are then tapped, a load of 1 $kg/cm^2$ is put onto the particle thus packed. A voltage which generates an electric field of 1,000 V/cm between the load and a bottom electrode is applied, and a current at this time is read as the resistivity. The insulating particles may be not only of the type in which a cladding layer of a resin or the like is deposited on the surface of the magnetic particles, but also of the type in which the magnetic particles are dispersed in a resin.

The carrier particles of the kind described above are produced in the same way as the conventional carrier particles, and their average particle sizes are classified by heretofore known means for classifying the average particle size, for use in the present invention.

The conventional non-magnetic or magnetic toner particles can also be used as the toner particles of the present invention after their average particle size is selected by the heretofore known means for classifying the average particle size. The toner particles preferably consist of magnetic particles of the type in which the toner particles contain fine magnetic particles. Particularly preferably, the quantity of the fine magnetic particles is up to 30% by weight. If the toner particles contain the magnetic particles, the toner particles are affected by the magnetic force of the magnet contained in the developer transfer support 2, so that the uniform ear forming property of the magnetic brush is further improved, the occurrence of the fog is prevented and the scatter of the toner particles becomes difficult to occur. If the quantity of the magnetic substance contained becomes too great, however, the magnetic force between it and the carrier particles becomes too great to obtain a sufficient developing density. In addition, the fine magnetic particles appear on the surface of the toner particles, thereby causing the problems that the control of friction charge is difficult, and the toner particles are likely to be damaged or to aggregate between the carrier particles.

The toner particles of the kind described above can be produced in the same way as the conventional production method of the toner particles, using the resin and magnetic fine particles described in conjunction with the carrier particles and by adding tinting components such as carbon and a charge control agent, whenever necessary.

The developer in the present invention is prepared by mixing the above-mentioned carrier and toner particles in the same proportion as their proportion in the convention two-component system developer. In addition, a fluidizing agent to improve fluidization and slide of the particles, a cleaning agent to clean the surface of the image retainer, and so forth, are further mixed, whenever necessary. Examples of the fluidizing agent include colloidal silica, silicone varnish, metallic soap, non-ionic surfactants, and so forth. Examples of the cleaning agent include surfactants such as metal salts of fatty acids, silicone substituted by organic groups, fluorine, and the like.

Development is then effected using the developer D and developing conditions described above, in the following two cases. First, the developer D attracted to the charged portion of the image retainer 1 consists solely of the toner particles, and the second is the case in which both toner and carrier particles are attracted and form a visible image on the image retainer 1. A desired result can be obtained by appropriately selecting either of these cases.

(1) To carry out development by the toner particles alone, the carrier particles must stay on the peripheral surface of the developer transfer support 2 and only the toner particles must oscillate between the image retainer 1 and the developer transfer support 2. In order to the toner particles to overcome the forces of attraction such as the Coulomb force with the carrier particles and van der Waals force, and to separate from the carrier particles, a high oscillating electric field and a high charge quantity of the toner particles are necessary together with a high force of retention of the magnet roller **2*b*** so as to prevent the oscillation of the carrier particles. In order to prevent the carrier particles from oscillating together with the toner particles, it is preferred that the particle size of the carrier particles is greater than that of the toner particles, the magnetic restriction force acting upon the carrier particles is greater than the electrostatic force transferring them to the image retainer, and the charge quantity of the toner particles is greater than 1 to 3 μc/g (preferably from 3 to 300 μc/g). A high charge quantity is necessary particularly when the particle size is small.

The method of forming the visible image on the image retainer 1 by use of only the toner particles provides the advantages that the surface of the image retainer 1 is not damaged by the carrier particles and that the visible image can be formed double on the image retainer 1 on which a visible image has already been formed.

(2) If the visible image is formed on the image retainer 1 by use of both toner and carrier particles, it is not necessary that the toner particles overcomes the force of attraction with the carrier particles and are separated from the latter. For these reasons, the requirements imposed on the toner and carrier particles are not much severe. Since the carrier particles may be oscillated by an oscillating electric field between the image retainer 1 and the developer transfer support 2, the particle size of the carrier particles may be smaller than that of the toner particles, and hence the force of magnetic restriction acting upon the carrier particles may be weak, and the charge quantity of the toner particles may be small. It is possible from above to use the carrier and toner particles having smaller particle sizes when compared with those of the item (1). When development is effected by use of the toner particles alone, a high quality visible image can not be formed easily if the average particle size of the carrier particles is below 10 μm and that of the toner particle is below 5 μm. When development is effected using both toner and carrier particles, the average particle size of the carrier particles of about 5 μm and that of the toner particles of about 1 μm can form a high quality picture. Since the toner particles are oscillated, the aggregation of the toner particles can also be prevented.

Incidentally, it is effective that a magnetic field is allowed to act in the oscillating zone of the developer, and is changed either time-wise or space-wise.

The following illustrates the results of experiments carried out by the inventors of the present invention under the conditions of development described above.

Experiment A

Spherical ferrite particles having an average particle size of 20 μm, magnetization of 50 emu/g and resistivity of $10^{10}$ Ohm-cm were used as the carrier particles, and non-magnetic particles consisting of 100 parts by weight of a styrene-acrylic resin ("Himer UP 110", produced by Sanyo Kasei K.K.), 10 parts by weight of carbon black ("MA-100", produced by Mitsubishi Kasei K.K.) and 5 parts by weight of Nigrosine, and having an average particle size of 10 μm, were used as the toner particles. Using the apparatus shown in FIG. 1, the development was conducted under the condition such that the proportion of the toner particles of the developer D in the developer stay 6 became 10 wt % with respect to the carrier particles.

In this case, the image retainer 1 consisted of a CdS photosensitive member, and its peripheral speed was 180 mm/sec. The highest potential of the electrostatic image formed on the image retainer 1 was −500 V. The outer diameter of the sleeve 2*a* was 30 mm, and its number of revolution was 100 rpm. The flux density of the N and S poles of the magnet roller 2*b* was 500 Gauss, and its number of revolution was 1,000 rpm. The thickness of the developer at the developing unit was 0.2 mm, and the spacing between the sleeve 2*a* and the image retainer 1 was 0.3 mm, or 300 μm. The bias voltage to be applied to the sleeve 2*a* was −250 V D.C. voltage component and 1.5 KHz, 400 V A.C. voltage component.

After development was conducted under the condition described above, the image was transferred to ordinary plain paper, and fixing was effected by passing the paper to a heat roller fixing device having a surface temperature of 140° C. The resulting picture on the recording paper was clear with an extremely high density but devoid of any edge effect and fog. Subsequently, when 50,000 reproduced papers were obtained, but the picture was stable from the start to the end. In contrast, reproduction was carried out to obtain a recording under the same condition as described above except that the bias voltage to be applied to the sleeve 2*a* consisted only of the D.C. voltage component. As a result, an unclear picture having a low density could be obtained. Similarly, the experiment was conducted under the same condition as above except that the spacing between the sleeve 2*a* and the image retainer 1 was changed to 3.0 mm, that is, 3,000 μm, and the thickness of the developer layer on the developing unit was changed to 0.7 mm. The picture thus obtained had an edge effect and a low density.

Experiment B

Insulating spherical ferrite particles having an average particle size of 15 μm, magnetization of 70 emu/g and a resistivity of at least $10^{14}$ Ohm-cm and coated by a resin were used as the carrier particles. Non-magnetic particles having an average particle size of 5 μm were used as the toner particles. Development was effected using the developing apparatus shown in FIG. 2 under the condition such that the ratio of the toner particles of the developer D at the developer stay 6 became 5 wt % to the carrier particles.

In this case, the condition of the image retainer 1 was the same as that of the Experiment A. The outer diameter of the sleeve 2*a* was also 30 mm, but its number of revolution was 150 rpm. The flux density of the magnetic pole of the magnet roller 2*b* opposing the developing unit A was 1,200 Gauss, and the developer layer in the developing region was 0.3 mm thick. The spacing between the sleeve 2*a* and the image retainer 1 was 0.4 mm, that is, 400 μm. The bias voltage to be applied to the sleeve 2*a* was −100 V D.C. voltage component and 3 KHz, 1,200 V A.C. voltage component.

After development was conducted under the condition described above, the image was transferred to plain paper and was passed through a heat roller fixing device having a surface temperature of 140° C. The resulting picture was extremely clear, had a high density but was devoid of any edge effect and fog. Subsequently, 50,000 copies were obtained, but the quality was found stable from the start to the end.

Reproduction was carried out to obtain a recording under the same condition as described above except that the bias voltage to the applied to the sleeve 2*a* consisted solely of the D.C. voltage component. The resulting picture was found inferior with respect to the density and clearness.

In contrast, recordings were obtained in the same way as described above except that the spacing between the sleeve 2*a* and the image retainer 1 was changed to 3.0 mm, that is, 3,000 μm, and the thickness of the developer layer at the developing unit was changed to 0.7 mm. As a result, the edge effect was observed in the resulting picture, which had a low density.

Experiment C

Resin dispersion type carrier particles prepared by dispersing 50 wt % of fine ferrite particles in a resin and having an average particle size of 10 μm, magnetization of 30 emu/g and a resistivity of at least $10^{14}$ Ohm-cm were used as the carrier particles. Magnetic particles consisting of 100 parts by weight of a styrene-acrylic resin ("Himer UP 110", produced by Sanyo Kasei K.K.), 10 parts by weight of carbon black ("MA-100", produced by Mitsubishi Kasei K.K.), 5 parts by weight of Nigrosine and 5 parts by weight of fine ferrite particles, and having an average particle size of 3 μm were used as the toner particles. Development was conducted using the apparatus shown in FIG. 1 under the condition such that the ratio of the toner particles of the developer D at the developer stay 6 become 10 wt % to the carrier particles.

In this case, the image retainer 1 consisted of a CdS photosensitive member, and its peripheral speed was 180 mm/sec. The highest potential of the electrostatic image formed on the image retainer 1 was −500 V. The outer diameter of the sleeve 2a was 30 mm, and its number of revolution was 100 rpm. The flux density of the N and S poles of the magnet roller 2b was 500 Gauss, and its number of revolution was 1,000 rpm. The developer layer at the developing unit was 0.2 mm thick. The spacing between the sleeve 2a and the image retainer 1 was 0.3 mm, that is, 300 μm. The bias voltage to be applied to the sleeve 2a was −250 V D.C. voltage component and 1.5 KHz, 400 V A.C. voltage component.

Development was conducted under the condition described above and the image was transferred to plain paper. The image was passed through a heat roller fixing device having a surface temperature of 140° C. The picture thus obtained was extremely clear, had a high density but was devoid of any edge effect and fog. Subsequently, 50,000 copies were obtained, but the picture was stable from the start to the end.

In contrast, recordings were obtained in the same way as above except that the bias voltage to be applied to the sleeve 2a consisted solely of the D.C. voltage component. The resulting picture was unclear and had a low density. The experiment was also carried out under the condition as described above except that the spacing between the sleeve 2a and the image retainer 1 was changed to 3.0 mm, that is, 3,000 μm, and the thickness of the developer layer at the developing unit was changed to 0.7 mm. The edge effect was observed in the resulting picture, which had a low density.

Experiment D

Insulating spherical ferrite particles having an average particle size of 4 μm, magnetization of 70 emu/g and a resistivity of $10^{14}$ Ohm-cm and coated by a resin were used as the carrier particles. Non-magnetic particles having an average particle size of 5 μm were used as the toner particles. Development was conducted using the apparatus shown in FIG. 3 under the condition such that the ratio of the toner particles of the developer D at the developer stay 6 became 5 wt % to the carrier particles.

In this case, the condition of the image retainer 1 was the same as that in the Experiment A. The outer diameter of the sleeve 2a was also 30 mm, but its number of revolution was 150 rpm. The flux density of the pole of the magnet roller 2b opposing the developing region A was 1,200 Gauss, and the density between the poles was 800 Gauss. The developer layer was 0.3 mm thick in the developing region, and the spacing between the sleeve 2a and the image retainer 1 was 0.4 mm, that is, 400 μm. The bias voltage to be applied to the sleeve 2a was −100 V D.C. voltage component and 3 KHz, 1,200 V A.C. component.

After development was conducted under the condition described above, the image was transferred to plain paper, and was then passed through a heat roller fixing device having a surface temperature of 140° C. for fixing. As a result, the picture of the recorded paper was extremely clear and had a high density but was devoid of any edge effect and fog. Subsequently, 50,000 copies were obtained, but the picture was stable from the start to the end. Other recorded papers obtained under the same conditions as above, except that the bias voltage applied to the sleeve 2a consisted of only a D.C. component, the resultant pictures had slightly lower densty and clarity than the former.

In contrast, recordings were obtained in the same way as above except that the spacing between the sleeve 2a and the image retainer 1 was changed to 3.0 mm, that is, 3,000 μm, and the thickness of the developer layer at the developing unit was changed to 0.7 mm. The resulting picture exhibited the edge effect and had a low density.

Incidentally, the oscillation of the carrier particles was not observed in the Experiments A and B. It was therefore believed that under the conditions of these experiments, the carrier particles did not substantially oscillate.

Figure 4:
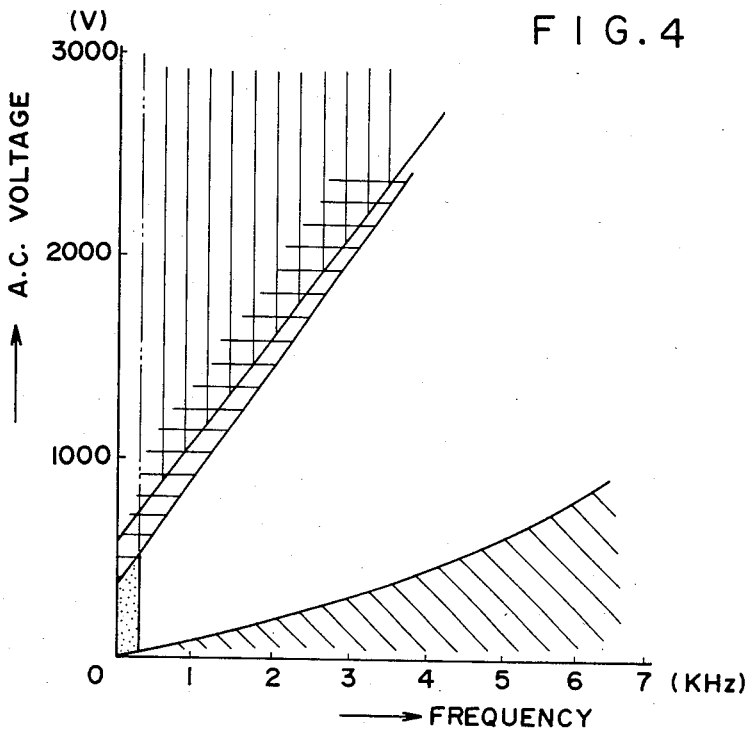
FIGS. 4, 5, 6, 7, 8, 9, 10, 11, 12, 13, 14 and 15 are diagrams showing the results obtained by the embodiments described above, respectively.
Figure 5:
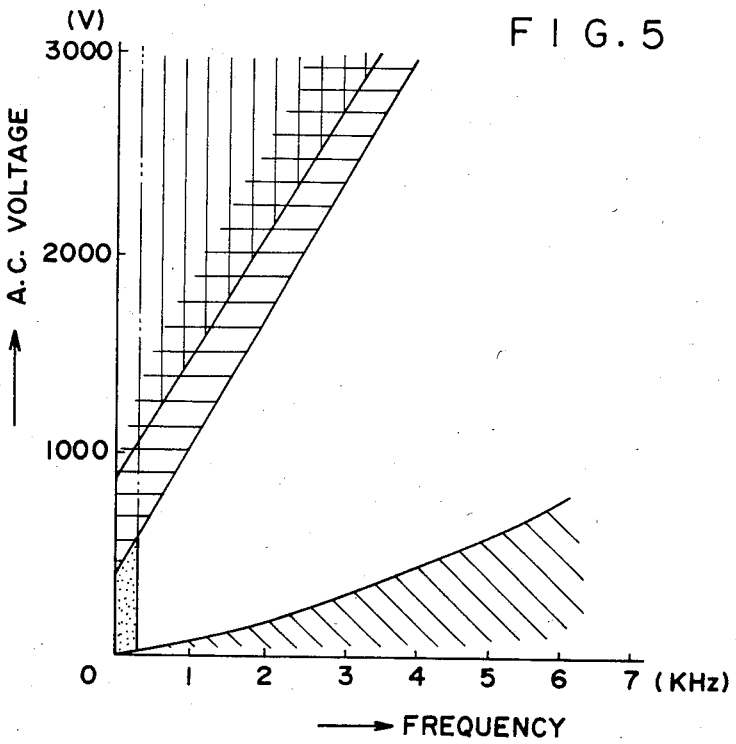

FIGS. 4 and 5 are diagrams, each showing the relation between the frequency and voltage of the A.C. voltage for generating the oscillating electric field under the condition which provided a satisfactory result in the Experiments A and B. In these diagrams, the portions hatched by transverse lines represent the range in which the occurrence of fog is observed, and those hatched by longitudinal lines do the range in which dielectric breakdown occurs. The portions hatched by inclined lines represent the range in which the picture quality drops, and the unhatched portions do the suitable range in which a visible image having a high quality can be obtained. The portions marked by scattered dots represent the range which is a low frequency range and in which non-uniformity of development is observed.

Figure 6:
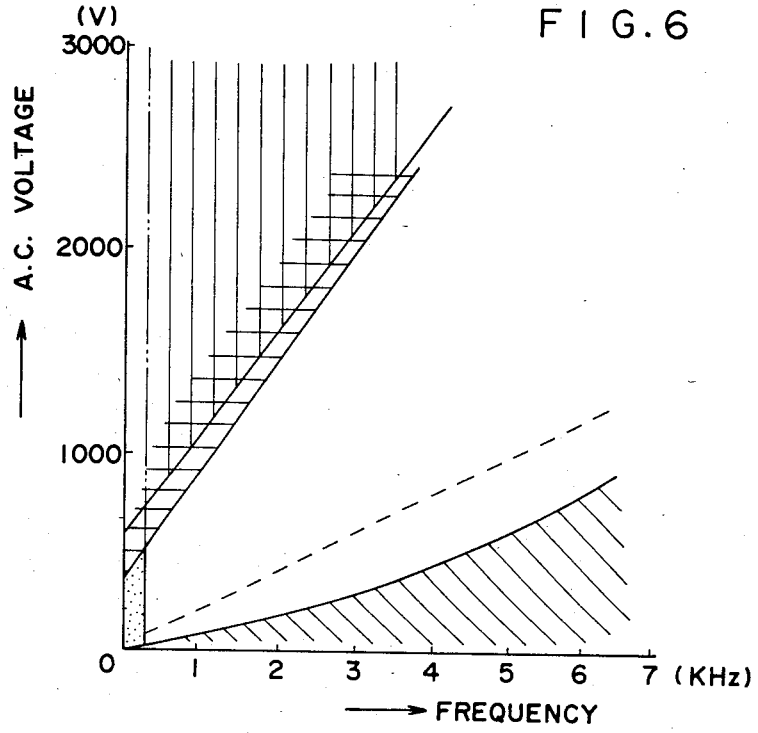
Figure 7:
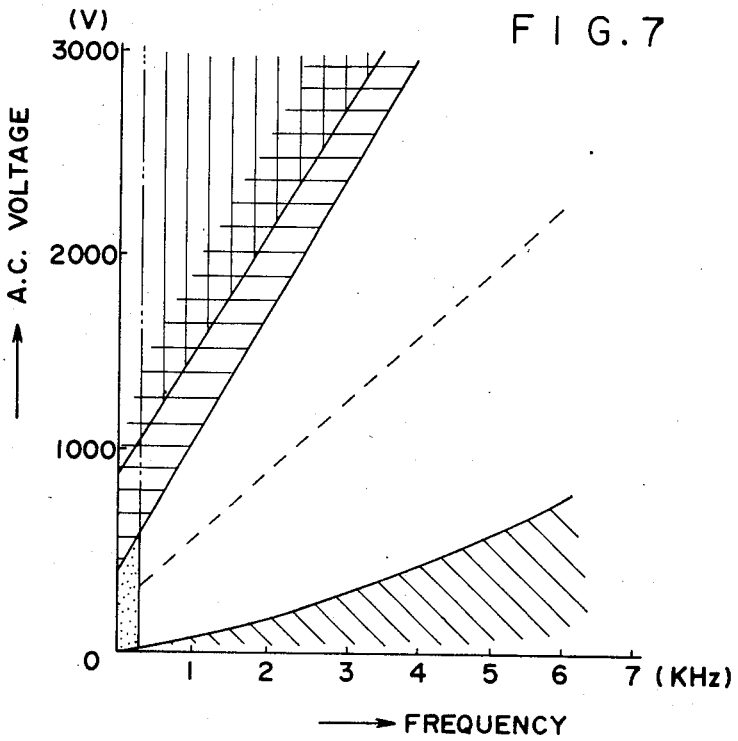

FIGS. 6 and 7 are diagrams, each showing the relation between the voltage and frequency of the alternating current for generating the oscillating electric field under the condition which provided the satisfactory results in the Experiments C and D. As can be seen from these diagrams, the results of the Experiments C and D are analogous to those of the Experiments A and B.

Incidentally, when the oscillation of the carrier particles was observed in the Experiments C and D, it was found occurring at the upper portion inside the suitable range, which is represented by dash lines, but not at the lower portion of the suitable range. Within this suitable range, the pictures obtained at the portions above the portions hatched by dash lines were found to possess excellent density, tone and resolution. The waveform of the A.C. voltage component in the present invention may be not only a sine wave but also a rectangular or triangular wave. So long as the toner of the two-component system developer is magnetic, a magnetic latent image can also be turned into a visible image under the same developing condition as described above.

In accordance with the conventional magnetic brush developing method, it has not been possible to obtain a high quality recorded picture because the perticle sizes of the toner and carrier particles can not be reduced when a two-component system developer is employed.

In accordance with the developing method of the electrostatic image of the present invention, the toner particles having an average particle size of between 1 and 20 μm and the carrier particles having an average particle size of between 5 and 50 μm are used under the condition in which oscillation is applied, so that a recording having a sufficient picture density, tone and resolution can be obtained.

Since the developer consists of two (or more) components, charge of the toner can be more stabilized and its aggregation becomes more difficult to occur than the one-component system developer.

In another embodiment of the developing method of the present invention, magnetic particles that are sphered are used as the magnetic carrier particles of the two-component system developer, and development is effected in the oscillating electric field. Accordingly, the magnetic carrier particles as well as the toner particles in the form of fine powder can be used without any trouble. The carrier of the developer used in this embodiment is preferably within the following suitable condition.

If the magnetic carrier particles are sphered, the stirring property of the toner and carrier and the transferability of the developer can be improved, so that the aggregation of the toner particles with one another and of the toner particles with the carrier particles can be prevented. Generally, however, if the average particle size of the magnetic carrier particles is great, the following problems occur:

(1) Since the ear of the magnetic brush formed on the developer transfer support is coarse, non-uniformity is likely to occur on the toner image even if the elastrostatic image is developed while applying oscillation thereto by the electric field.

(2) Since the toner density in the ear drops, development with a high density can not be effected.

The problem (1) can be solved by reducing the average particle size of the carrier particles. According to the experimental result, this effect starts appearing from the average particle size of below 50 μm. Particularly when the average particle size is below 30 μm, it is found that the problem (1) does not virtually occur. The second problem can also be solved by reducing the particle size of the magnetic carrier to solve the first problem. For, the toner density of the ear becomes high and development can be effected with a high density. If the carrier particles are too fine, however, (3) they are likely to attach to the surface of the image retainer together with the toner particles, and (4) they are likely to scatter. These phenomena are related with the intensity of magnetic field acting upon the carrier particles and upon the intensity of the magnetization of the carrier particles due to the magnetic field. Generally, however, the phenomena start appearing gradually when the average particle size of the carrier particles is below 15 μm, and remarkably when the average particle size is below 5 μm.

Part of the carrier particles attaching to the surface of the image retainer is transferred together with the toner onto the recording paper, while the rest are removed together with the toner from the surface of the image retainer by the blade, a fur brush, and the like. However, the conventional carrier particles which consist of a magnetic substance alone, involves the following problems.

(5) The carrier particles, that are transferred onto the recording paper, are not by themselves fixed to the recording paper, and hence are likely to peel therefrom.

(6) When the carrier particles remaining on the surface of the image retainer are removed by the cleaning device, they are likely to damage the surface of the image retainer consisting of a photosensitive member.

These problems (5) and (6) can be solved by forming the magnetic carrier particles together with a material that can be fixed to the recording paper, such as a resin. In other words, if the magnetic carrier particles are covered by a material that can be fixed to the recording paper, or if the carrier consists of a material in which the magnetic powder is dispersed and which can be fixed to the recording paper, or if a thermoplastic resin is used for the magnetic carrier particles, the carrier particles attaching to the recording paper can also be fixed by the heat or the pressure, and do not damage the surface of the image retainer when they are removed by the cleaning device from the surface of the image retainer. If such carrier particles have an average particle size of from 5 to 15 μm, the afore-mentioned proble (3) does not practically occur, even if the carrier particles are transferred to the surface of the image retainer and to the recording paper. Incidentally, if carrier deposition such as the problem (3) occurs, it is effective to dispose a recycling mechanism.

From above, the particle size of the sphered magnetic carrier is below 50 μm and especially preferably, from 30 μm to 5 μm. It is also preferred that the sphered magnetic carrier particles contains a substance that can be fixed to the recording paper.

The conventional magnetic carrier particles can be used as such carrier particles.

Examples of the carrier particles include sphered particles of ferromagnetic or magnetic particles of iron, chromium, nickel, cobalt and their compounds or alloys as represented by triiron tetraoxide, γ-ferric oxide, chromium dioxide, manganese oxide, ferrite, manganese-copper type alloys, and the like; sphered particles obtained by coating the surface of the particles of the materials described above by resins such as styrene type resins, vinyl type resins, ethyl type resins, rosin modified resins, acrylic type resins, polyamide resins, epoxy resins, polyester resins, and the like, or by aliphatic acid wax such as palcitinic acid, stearic acid, and the like; and particles obtained by classifying by heretofore known means for classifying the average particle size the particles of resin including magnetic fine particles dispersed thereinto or obtained from the sphered aliphatic acid wax.

If the carrier particles are sphered by a resin or the like, the additional effects that the developer layer can be uniformly formed on the developer transfer support and a high bias voltage can be applied to the developer transfer support, can be obtained besides the effect described already. In other words, if the carrier particles are sphered by a resin or the like, the following effects can be obtained.

(1) Generally, the carrier particles are likely to be magnetized and attracted in the direction of the major axis, but when sphered, they lose their directivity. Hence, the developer layer can be formed uniformly, and the occurrence of a region having a locally low resistance and the non-uniformity of the layer thickness can be prevented.

(2) As the resistance of the carrier particles becomes higher, the edge portion of the carrier particle that has occurred in the conventional carrier particles is eliminated and the concentration of the electric field upon the edge portion does not occur, so that even if a high bias voltage is applied to the developer transfer support, neither discharge to the surface of the image retainer that disturbs the electrostatic latnet image, nor break-down of the bias voltage occur.

This ability of the application of a high bias voltage means that the following effects can be fully exhibited when development in the present invention under the oscillating electric field is effected by the application of an oscillating bias voltage. The wax can be used for the sphered carrier particles exhibiting such effects as described earlier, but in view of the durability of the carrier, the resin such as described above is more preferred. Hence, the magnetic carrier particles are sphered in which the ratio of the major axis to the minor axis is below at least 3 times and have no sharp portion or edge portion. It is preferable that the magnetic carrier particles have a resistivity of at least $10^8$ Ohm-cm, more preferable at least $10^{13}$ Ohm-cm.

The magnetic carrier particles of the type described above can be produced in the following manner. If the carrier particles are spherical magnetic particles having an increased resistance of resin-coated carriers, those magnetic particles which are as spherical as possible are selected and are then subjected to coating treatment with a resin. If the carriers are of a dispersion type of fine magnetic particles, those fine particles which are as highly magnetic as possible are selected and are then subjected to the sphering treatment after forming the dispersing resin particles or by use of a spray dry method to obtain the dispersing resin particles.

Experiment E

Resin-coated spherical ferrite particles having an average particle size of 30 μm, magnetization of 50 emu/g and a resistivity of at least $10^{14}$ Ohm-cm were used as the carrier. Non-magnetic particles consisting of 100 parts by weight of a styrene-acrylic resin ("Himer UP 110", produced by Sanyo Kasei K.K.), 10 parts by weight of carbon black ("MA-100", produced by Mitsubishi Kasei K.K.) and 5 parts by weight of Nigrosine, having an average particle size of 10 μm and obtained by a milling granulation method were used as the toner. Development was effected using the apparatus shown in FIG. 1 so that the ratio of the toner particles of the developer D at the developer stay 6 became 10 wt % to the carrier particles. The average charge quantity of the toner was 15 μC/g.

In this case, the image retainer 1 consisted of a CdS photosensitive member and its peripheral speed was 180 mm/sec. The highest potential of the electrostatic image formed on the image retainer 1 was −500 V. The outer diameter of the sleeve 2a was 30 mm and its number of revolution was 100 rpm. The flux density of the N and S poles of the magnet 2b was 900 Gauss, and its number of revolution was 1,000 rpm. The thickness of the developer layer in the developing zone A was 0.6 mm, and the spacing between the sleeve 2a and the image retainer 1 was 0.5 mm, that is, 500 μm. The bias voltage to be applied to the sleeve 2a was −250 V D.C. voltage component and 1.5 KHz, 500 V A.C. voltage component. In other words, the developer layer came into contact with the surface of the image retainer 1 in this case, as shown in FIG. 1.

After development was effected under the condition described above, the image was transferred to plain paper using a corona discharge transfer device, and was thereafter fixed by passing the paper through a heat roller fixing device having a surface temperature of 140° C. The resulting picture on the recording paper had a high density and was extremely clear, but was devoid of any edge effect and fog. Subsequently, when 50,000 copies were obtained, but the picture remained stable and unaltered from the start to the end.

In contrast, when milled ferrite particles, which exhibited substantially the same properties as the carrier particles described above but were resin-coated and had an average particle size of 30 μm, were used as the carrier particles, the voltage of the A.C. voltage component that could be applied was about ⅔ of the voltage described above at most, and the coarseness was observed in the resulting picture.

Experiment F

Magnetic particles produced by dispersing 50 wt % of fine ferrite particles in a resin, having an average particle size of 20 μm, magnetization of 30 emu/g and a resistivity of at least $10^{14}$ Ohm-cm and subjected to the sphering treatment by heating were used as the carrier particles. Non-magnetic particles having an average particle size of 5 μm were used as the toner particles. Development was conducted using the apparatus shown in FIG. 3 in such a fashion that the ratio of the toner particles of the developer D at the developer stay 6 became 5 wt % to the carrier particles. The average charge quantity of the toner was 30 μC/g.

In this case, the condition of the image retainer 1 was the same as that in Experiment E. The outer diameter of the sleeve 2a was 30 mm, but its number of revolution was 150 rpm. The flux density of the pole of the magnet 2b opposing the developing zone A was 1,200 Gauss. The thickness of the developer layer was 0.5 mm, and the spacing between the sleeve 2a and the image retainer 1 was 0.7 mm, that is, 700 μm. The bias voltage to be applied to the sleeve 2a was −200 V D.C. voltage component and 2 KHz, 1,000 V A.C. voltage component. In this experiment, the developer layer on the sleeve 2a was out of contact with the surface of the image retainer 1.

After development was effected under the condition described above, the developed image was transferred to plain paper by corona discharge and was then passed through a heat roller fixing device having a surface temperature of 140° C. for fixing. The resulting picture had a high density and was extremely clear, but was devoid of any edge effect and fog. Subsequently, 50,000 copies were obtained, but the picture remained stable and unaltered from the start to the end.

In contrast, when those particles which were not subjected to the sphering treatment by heating described above was used as the carrier particles, the voltage of the A.C. voltage component that could be applied was about ⅔ of the voltage described above, and the coarseness was observed in the picture.

Experiment G

Magnetic particles produced by dispersing 50 wt % of fine ferrite particles in a resin, having an average particle size of 20 μm, magnetization of 30 emu/g and a resistivity of at least $10^{14}$ Ohm-cm and subjected to the sphering treatment by heating were used as the carrier particles. Non-magnetic particles having an average particle size of 5 μm were used as the toner particles. Development was conducted using the apparatus substantially the same as one shown in FIG. 1 in such a fashion that the ratio of the toner particles of the developer D at the developer stay 6 become 5 wt % to the carrier particles, except that the developer layer did not come into contact with the surface of the image retainer 1. The average charge quantity of the toner was 30 μc/g.

The condition of the image retainer 1 in this case was the same as that of Experiment E. The outer diameter of the sleeve 2a was 30 mm, but its number of revolution was 100 rpm. The flux density of the N and S poles was 700 Gauss, and its number of revolution was 500 rpm. The thickness of the developer layer was 0.7 mm, that is, 700 μm. The bias voltage to be applied to the sleeve 2a was −200 D.C. voltage component and 2 KHz, 1,000 V A.C. voltage component.

After development was effected under the condition described above, the developed image was transferred to plain paper by corona discharge and was then passed through a heat roller fixing device having a surface temperature of 140° C. for fixing. The resulting picture had a high density and was extremely clear but was devoid of any edge effect and fog. It was superior to the picture obtained in Experiment F because it had higher resolution and density. Subsequently, 50,000 copies were obtained, but the picture remained stable from the start to the end.

In contrast, those particles which were not subjected to the sphering treatment by heating were used as the carrier particles, the voltage of the A.C. voltage component that could be applied was about $\frac{2}{3}$, at most, of the voltage described above, and the coarseness was observed in the picture.

Figure 8:
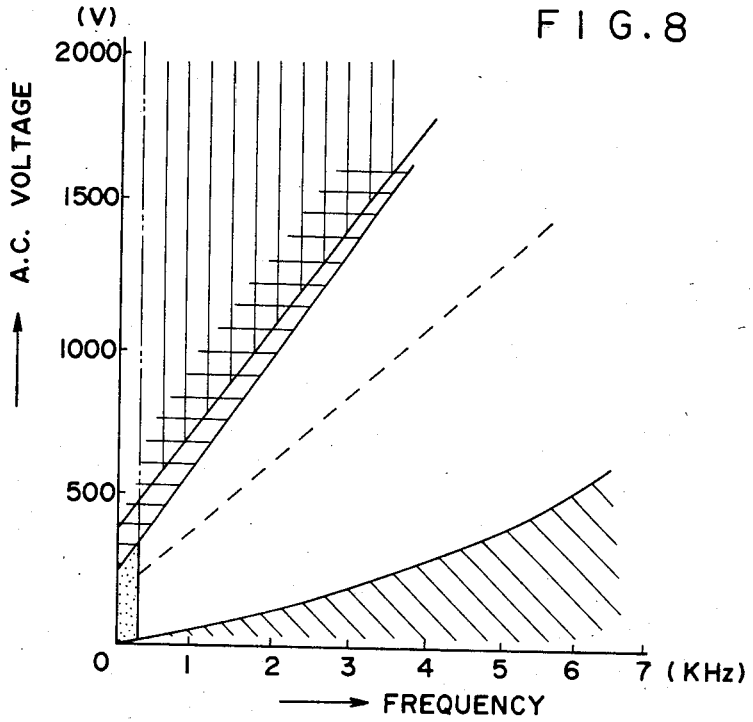
Figure 9:
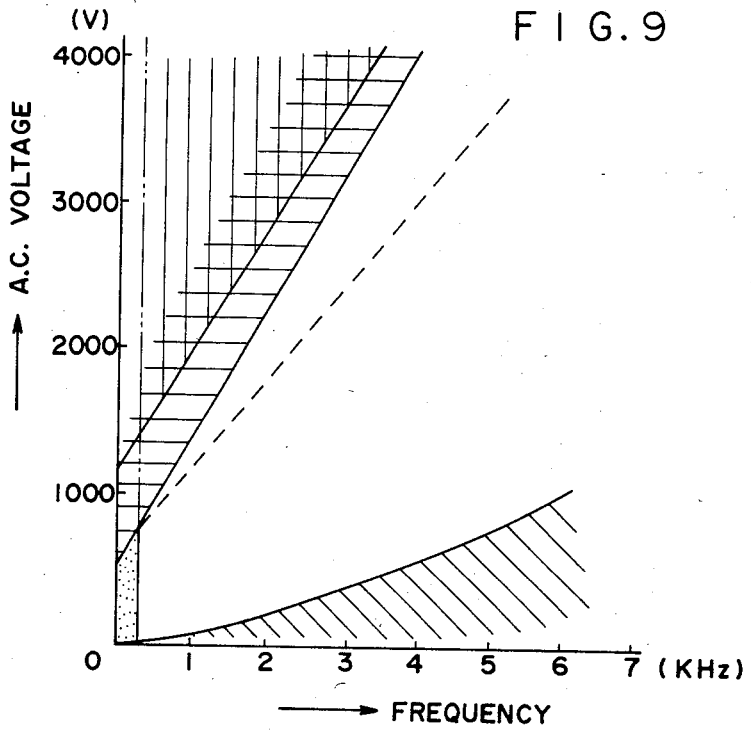

Incidentally, in the Experiments E, F and G described above, when the frequency and voltage of the A.C. voltage component to be applied to the sleeve 2a were changed, the results obtained were shown in FIGS. 8 and 9, respectively.

FIGS. 8 and 9 are diagrams, each showing the relation between the voltage and frequency of the alternating current for generating the oscillating electric field under the condition which provided the satisfactory results in the Experiments E, and F or G. As can be seen from these diagrams, the results of the Experiments E, F and G are analogous to those of the Experiments A and B.

In FIGS. 8 (Experiment E) and 9 (Experiments F and G), the ranges above the dash lines were dielectric break-down ranges when the carrier particles were not spherical.

This embodiment of the present invention provides the excellent effects that a clear reproduced picture devoid of any fog can be obtained by use of the carrier having an average particle size of 30 μm or below and the toner having an average particle size of up to 10 μm.

In the developing method in accordance with still another embodiment of the present invention, development is effected by use of the spherical toner for the two-component system developer under the oscillating electric field, so that the fine toner particles and the fine magnetic carrier particles can be used without any trouble. The toner of the developer used in this embodiment is preferably under the following suitable condition.

At first, the toner particles from together with the magnetic carrier particles the developer layer on the developer transfer support. Then, the toner particles are separated from the developer layer by the electric field generated between the developer transfer support and the image retainer, and are attracted by, and move towards, the electrostatic or magnetic latent image formed on the image retainer. Thereafter, the resulting toner image is transferred and fixed onto the recording paper either directly or via an intermediate transfer member. For these reasons, the toner must form the developer layer in a suitable density in cooperation with the carrier particles, and must be separated from the carrier particles of the developer layer and be selectively attracted to the electrostatic latent image or the like. Furthermore, it must have such a property that it can be easily transferred from the image retainer.

In order to fully satisfy these requirements, the present invention uses the spherical toner particles. If spherical, the toner particles exhibit higher fluidity, improve the charge due to friction with the carrier particles, and hence form the developer layer in a suitable density in cooperation with the carrier particles. When development is effected, the spherical toner particles can be smoothly separated from the developer layer, can be selectively attracted by the electrostatic image or the like, and can be also transferred easily from the surface of the image retainer. It is believed that if the toner particles are spherical, the contact areas between the toner particles and the carrier particles and between the toner particles and the surface of the image retainer are reduced, so that the non-uniform force such as the van der Waals force, that can not be easily controlled, can be minimized, and the spherical shape does not cause the charge concentration and the neutralization of discharge unlike the needle-like proturberance, edge or thinly elongated shapes. Hence, the toner particles are sphered in a suitable range in which the ratio of the major axis to the minor axis is below at least 3 times.

The spherical toner particles such as described above can be produced by the following various methods. The starting materials consist of resins such as a styrene type resin, a vinyl type resin, a rosin-modified resin, an acrylic type resin, a polyamide type resin, an epoxy resin, a polyester resin, or the like, a tinting component such as carbon, and a charge controller that is to be added, whenever necessary. When the toner is of the magnetic type, it further contains fine particles of ferromagnetic or magnetic substances such as a metal, e.g., iron, chromium, nickel, cobalt, or the like, their compounds and alloys, e.g. triiron tetraoxide, α-ferric oxide, chromium dioxide, manganese oxide, ferrite, manganese-copper type alloys, and the like. The toner is produced from these starting materials by the spray dry method, for example, which fuses and kneads these materials together, then dissolves them in a solvent, jets the resulting solution from a nozzle into hot air, and evaporates the solvent from the jetted droplets to obtain the spherical particles. A flow coater method mills the solidified mixture of the fused and kneaded mixture, and jets the resulting milled particles into hot air so as to fuse the resin component in the particles and thus to sphere the particles. A granulation polymerization method polymerizes and precipitates the resin in a solution of a prepolymer from which the tinting component or the like is separated. In place of the flow coater method described above, still another method stirs the toner particles in hot water so as to soften and sphere the resin, and then filtrates and dries the resin. Incidentally, the toner particles may be micro-capsulated, and the production methods and sphering treatment described above can also be applied to such toner particles.

Generally, if the average particle size of the toner particles becomes smaller, the charge quantity drops qualitatively in proportion to the square of the particle size, while the force of attraction such as van der Waals force that can not be controlled easily increases, on the contrary. Accordingly, the toner particles become difficult to separate from the carrier particles, and once the toner particles attach to the non-image portions on the surface of the image retainer, they can not be removed easily by the friction by the conventional magnetic brush, but generate the fog. This problem is observed remarkably in the conventional magnetic brush developing method particularly when the average particle size of the toner particles is below 10 μm. the spherical toner particles and by effecting the development by the developer layer under the oscillating electric field. In other words, the toner particles attaching to the developer layer can be easily transferred to the image and non-image portions on the surface of the image retainer from the developer layer by the oscillation applied electrically, and can also be separated easily therefrom. When the developer layer is caused to frictionize the surface of the image retainer, the toner particles attaching to the non-toner portions of the image retainer can be easily removed or can be easily transferred to the electrostatic image portion.

If the thickness of the developer layer is smaller than the spacing between the surface of the image retainer and the developer transfer support, the toner particles having a low charge quantity are hardly transferred to the image and non-image transfer portions and are hardly brought into friction with the surface of the image retainer. Accordingly, the toner particles do not attach to the image retainer due to frictional charge, and the toner particles having an average particle size of as small as about 1 μm can be used. Accordingly, a clear toner image developing the electrostatic latent image with a high level of fidelity and reproducibility can be obtained. Furthermore, since the oscillating electric field weakens the coupling between the toner and carrier particles, attachment of the carrier particles together with the toner particles can be reduced. Particularly when the thickness of the developer layer is made smaller than the spacing between the surface of the image retainer and the developer transfer support as described above, the toner particles having a high charge quantity oscillate inside the oscillating field at the image and non-image portions, and the carrier particles also oscillate depending upon the intensity of the electric field, so that the toner is selectively transferred to the electrostatic image portion on the surface of the image retainer, and hence the attachment of the carrier to the surface of the image retainer can be remarkably reduced.

On the other hand, if the average particle size of the toner becomes great, the coarseness of the picture becomes remarkable, as described earlier. Generally, development having resolution such that thin aligned with a pitch of about 10 lines/mm is reproduced, can be effected practically without any problem even if a fine toner having an average particle size of about 20 μm is used. If a fine toner having an average particle size of below 10 μm is used, however, resolution can be improved drastically, and a high quality picture reproducing the difference of densities with a high level of fidelity can be obtained. For the reasons described above, the average particle size of the toner is below 20 μm and preferably, below 10 μm. In order for the toner particles to follow up the electric field, it is preferred that the charge quantity of the toner particles be greater than 1 to 3 μC/g. A higher charge quantity is necessary particularly when the particle size is small. The toner satisfying these suitable conditions can be obtained by the methods described already, and can be classified by heretofore known means for classifying the average particle sizes, whenever necessary.

Among the toners thus obtained, the toner particles are preferably magnetic toner particles containing fine magnetic particles. Particularly preferably, the amount of the magnetic fine particles is up to 60 wt % and more preferably, up to 30 wt %. When the toner particles contain the magnetic particles, they are affected by the magnetic force of the magnet contained in the developer transfer support, so that the uniform formability of the magnetic brush can be further improved, the occurrence of fog is prevented and the scatter of the toner particles becomes difficult to occur. If the amount of the magnetic substance becomes too great, however, the magnetic force between the toner and carrier particles becomes too great to obtain a sufficient developing density. Moreover, the fine magnetic particles appears on the surface of the toner particles, so that the control of frictional charge becomes difficult, and the toner particles are likely to be broken and to aggregate between the carrier particles.

Experiment H

Non-magnetic particles consisting of 100 parts by weight of a styrene-acrylic resin ("Himer UP 110", produced by Sanyo Kasei K.K.), 10 parts by weight of the carbon black ("MA-100", produced by Mitsubishi Kasei K.K.) and 5 parts by weight of Nigrosine, sphered by the afore-mentioned flow coater method after milling and granulation and having an average particle size of 10 μm, were used as the toner. Resin-coated spherical ferrite particles having an average particle size of 30 μm, magnetization of 50 emu/g and a resistivity of $10^{14}$ Ohm-cm were used as the carrier. Development was conducted using the apparatus shown in FIG. 1 in such a fashion that the ratio of the toner of the developer D at the developer stay 6 became 10 wt % to the carrier particle. The averaage charge quantity of the toner was 15 μC/g.

In this case, the image retainer 1 consisted of a CdS photosensitive member, and its peripheral speed was 180 mm/sec. The highest potential of the electrostatic image formed on the image retainer 1 was −500 V. The outer diameter of the sleeve 2a is 30 mm, and its number of revolution was 100 rpm. The flux density of the N and S poles of the magnet 2a was 900 Gauss, and its number of revolution was 1,000 rpm. The thickness of the developer layer was 0.6 mm, and the spacing between the sleeve 2a and the image retainer 1 was 0.5 mm, that is, 500 μm. The bias voltage to be applied to the sleeve 2a was −250 V D.C. component and 1.5 KHz, 500 V A.C. voltage component. In other words, development was conducted in this embodiment while the developer layer was kept in contact with the image retainer 1.

After development was effected under the condition described above, the developed image was transferred to plain paper by use of a corona discharger, and was passed through a heat roller fixing device for fixing. The resulting picture on the recording paper had a high density and was extremely clear, but was devoid of any edge effect and fog. Subsequently, 50,000 copies were obtained, but the picture remained stable and unaltered from the start to the end.

In contrast, when the toner produced by omitting the sphering treatment using the hot air in the flow coater method was used, the resulting picture was inferior to the picture obtained above in the viewpoints of fog and clearness, although the rest of the conditions were the same as above.

Experiment I

Non-magnetic particles having an average particle size of 5 μm and sphered by the flow coater method were used as the toner, while magnetic particles produced by dispersing 50 wt % of fine ferrite particles in a resin, having an average particle size of 20 μm, magnetization of 30 emu/g and a resistivity of at least $10^{14}$ Ohm-cm and subjected to the sphering treatment, were used as the carrier. Development was conducted using the apparatus shown in FIG. 3 in such a fashion that the ratio of the toner of the developer D at the developer stay 6 became 5 wt % to the carrier. The average charge quantity of the toner was 30 μC/g.

The condition of the image retainer 1 in this case was the same as in Experiment H. The outer diameter of the sleeve 2*a* was 30 mm, but its number of revolution was 150 rpm. The flux density of the pole of the magnet 2*b* opposing the developing zone A was 1,200 Gauss, and the thickness of the developer layer was 0.6 mm. The spacing between the sleeve 2*a* and the image retainer 1 was 0.7 mm, that is, 700 μm. The bias voltage to be applied to the sleeve 2*a* was −200 V D.C. voltage component and 2 KHz, 1,000 V A.C. voltage component. In this embodiment, the developer layer on the sleeve 2*a* was thinner than the spacing between the sleeve 2*a* and the image retainer 1.

After development was effected under the condition described above, the developed image was transferred to plain paper and was then passed through a heat roller fixing device having a surface temperature of 140° C. for fixing. The resulting picture on the recording paper had a high density and was extremely clear, but was devoid of any edge effect and fog. Sunsequently, 50,000 copies were obtained, but the picture remained stable from the start to the end.

In contrast, when the toner which was produced by omitting the sphering treatment by the hot air in the flow coater method was used, the resulting picture was inferior to the picture described above in viewpoints of fog and clearness, although the rest of the conditions were the same as those described above.

Experiment J

Development was conducted using the developer D whose toner and carrier were the same as those of the developer in Experiment I and using also the apparatus having substantially the same construction as one shown in FIG. 1, in such a fashion that the ratio of the toner particles of the developer D at the developer stay 6 became 5 wt % to the carrier particles. In this case, the average charge quantity of the toner was 30 μC/g.

In this case, the condition of the image retainer was the same as that of Experiment H. The outer diameter of the sleeve 2*a* was 30 mm, but its number of revolution was 100 rpm. The flux density of the N and S poles was 700 Gauss, and the number of revolution was 500 rpm. The thickness of the developer layer was 0.6 mm. The spacing between the sleeve 2*a* and the image retainer 1 was 0.7 mm, that is, 700 μm. The bias voltage to be applied to the sleeve 2*a* was −200 V D.C. voltage component and 2 KHz, 1,000 V A.C. voltage component.

After development was effected under the condition described above, the developed image was transferred to plain paper by corona discharge, and was then passed through a heat roller fixing device having a surface temperature of 140° C. for fixing. The resulting picture on the recording paper had a high density and was extremely clear, but devoid of any edge effect and fog. The picture was superior to the picture obtained in Experiment I in the viewpoints of higher resolution and higher density. Subsequently, 50,000 copies were obtained, but the picture remained stable and unaltered from the start to the end.

In contrast, when the toner which was produced by omitting the sphering treatment was used, the resulting picture was inferior in its fog and clearness, in the same way as the result of comparison of Experiment I.

Figure 10:
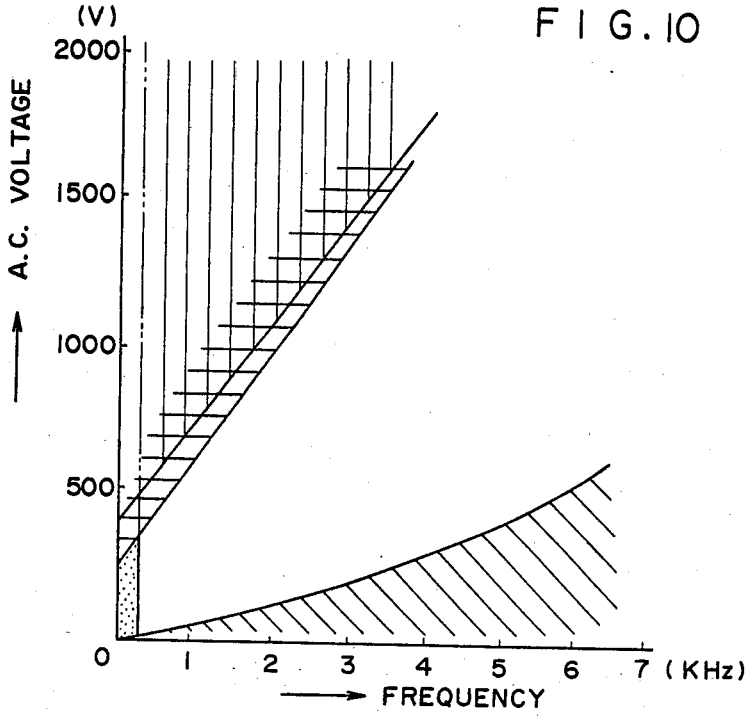
Figure 11:
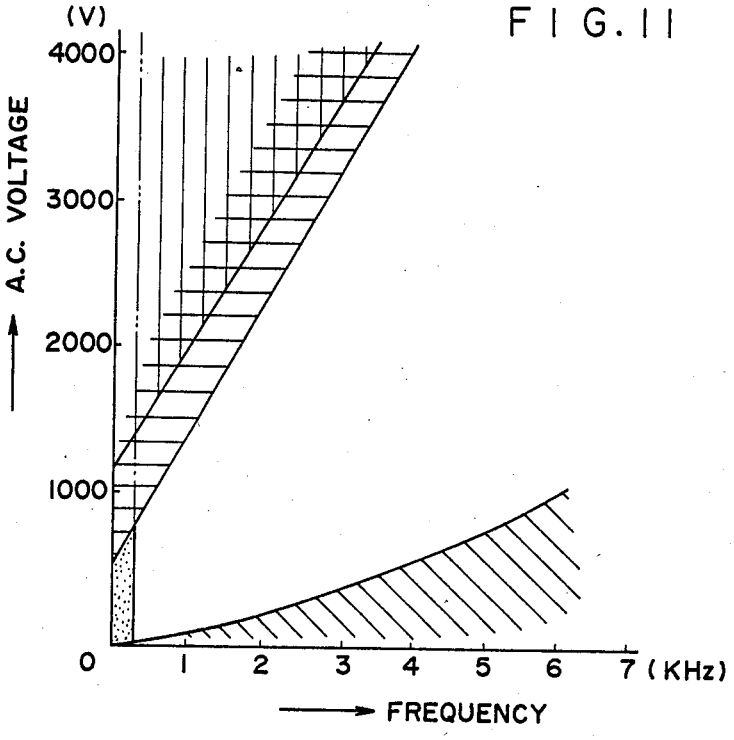

When the frequency and voltage of the A.C. voltage component to be applied to the sleeve 2*a* were changed in the Experiments H, I and J, the results were shown in FIG. 10 (Experiment H) and in FIG. 11 (Experiments I and J), respectively.

As can be understood clearly from the Experiments described above, the developing method of the present invention which effects development by the two-component system developer using the spherical toner particles under the oscillating electric field can provide a recorded picture devoid of any fog but having excellent clearness that can not be obtained by the conventional developing methods.

In the developing method in accordance with still another embodiment of the present invention, the magnetic carrier particles of the two-component system developer consist, for example, of magnetic particles and a resin such as a resin dispersion system of the magnetic powder and the resin or resin-coated magnetic particles, and further preferably, they are sphered. The magnetic carreir particles have an average particle size of preferably up to 50 μm and particularly preferably, from 30 μm to 5 μm.

The preferred toner to be used in this embodiment uses the resin and further the fine particles of the magnetic substance such as those described for the carrier, and contains also the tinting component such as carbon black, and a charge controller, whenever necessary. The toner can be produced by the heretofore known method of producing the toner particles, and has an average particle size of up to 20 μm and particularly preferably, up to 10 μm.

Experiment K

Resin-coated spherical carrier particles obtained in the following way were used as the carrier particles. Ferrite particles having an average particle size of 25 μm were floated by hot air, and the same styrene-acrylic resin as used for the toner particles was dissolved in a solvent. The solution was sprayed from a nozzle to the toner particles, which were then dried to provide the toner particles having an average particle size of 30 μm, magnetization of 50 emu/g and a resistivity of at least $10^{14}$ Ohm-cm. Non-magnetic particles produced by milling and granulating a mixture of 100 parts by weight of the styrene-acrylic resin ("Himer UP 100", produced by Sanyo Kasei K.K.), 10 parts by weight of carbon black ("MA-100, produced by Mitsubishi Kasei K.K.) and 5 parts by weight of Nigrosine, and having an average particle size of 10 μm, were subjected to the sphering treatment by use of the hot air. The non-magnetic particles thus obtained were used as the toner particles.

Development was then conducted using the apparatus shown in FIG. 1 in such a fashion that the ratio of the toner particles of the developer D at the developer stay 6 became 10 wt % to the carrier particles. In this case, the average charge quantity of the toner particles were 15 μC/g.

In this case, too, the image retainer 1 was a CdS photosensitive member, and its peripheral speed was 180 mm/sec. The highest potential of the electrostatic image formed on the image retainer 1 was −500 V. The outer diameter of the sleeve 2a was 30 mm, and its number of revolution was 100 rpm. The flux density of the N and S poles of the magnet 3 was 900 Gauss, and the number of revolution was 1,000 rpm. The thickness of the developer layer in the developing zone A was 0.6 mm, and the spacing between the sleeve 2a and the image retainer 1 was 0.5 mm, that is, 500 μm. The bias voltage to be applied to the sleeve 2a was −250 V D.C. voltage component and 1.5 kHz 500 V A.C. component.

After development was effected under the condition described above, the developed image was transferred to plain paper by a corona discharger, and was then passed through a heat roller fixing device having a surface temperature of 140° C. for fixing. The resulting picture on the recording paper had a high density and was extremely clear, but was devoid of any edge effect and fog. Subsequently, 50,000 copies were obtained, but the picture remained stable and unaltered from the start to the end.

Experiment L

The styrene-acrylic resin in which 50 wt % of fine ferrite particles having an average particle size of 0.2 μm, were dispersed and was the same as the resin of Experiment K was milled and then subjected to the hot air treatment to provide spherical particles having an average particle size of 20 μm, magnetization of 30 emu/g and a resistivity of at least $10^{14}$ Ohm-cm. The particles thus obtained were used as the carrier particles. On the other hand, the spherical non-magnetic particles having the same composition as the non-magnetic particles of Experiment K, obtained by the flow coater method and having an average particle size of 5 μm, were used as the toner particles. Development was conducted using the apparatus shown in FIG. 3 in such a fashion that the ratio of the toner particles of the developer D at the developer stay 6 became 5 wt % to the carrier particles. The average charge quantity of the toner was 30 μC/g.

In this case, the condition of the image retainer 1 was the same as that of Experiment K. The outer diameter of the sleeve 2a was 30 mm, but its number of revolution was 150 rpm. The flux density of the pole of the magnet 2b opposing the developing zone A was 1,200 Gauss. The thickness of the developer layer was 0.6 mm, and the spacing between the sleeve 2a and the image retainer 1 was 0.7 mm, that is 700 μm. The bias voltage to be applied to the sleeve 2a was −200 V D.C. voltage component and 2 KHz, 1,000 V A.C. voltage component.

After development was effected under the condition described above, the developed image was transferred to plain paper by corona discharge, and was then passed through a heat roller fixing device having a surface temperature of 140° C. for fixing. The resulting picture on the recording paper had a high density and was extremely clear, but was devoid of any edge effect and fog. Subsequently, 50,000 copies were obtained, but the picture remained stable and unaltered from the start to the end.

Experiment M

Development was conducted using the developer D whose carrier and toner particles were the same as those of the developer D of Experiment L and using an developing apparatus having substantially the same construction as one shown in FIG. 1, in such a fashion that the ratio of the toner particles of the developer D at the developer stay 6 became 5 wt % to the carrier particles. The average charge quantity of the toner in this case was 30 μC/g.

The condition of the image retainer 1 in this case was the same as that of the Experiment K. The outer diameter of the sleeve 2a was 30 mm, but its number of revolution was 100 rpm. The flux density of the N and S poles was 700 Gauss, and the number of revolution was 500 rpm. The thickness of the developer layer was 0.6 mm, that is, 600 μm. The spacing between the sleeve 2a and the image retainer 1 was 0.7 mm, that is, 700 μm. The bias voltage to be applied to the sleeve 2a was −200 V D.C. voltage component and 2 KHz 1,000 V A.C. voltage component.

Figure 12:
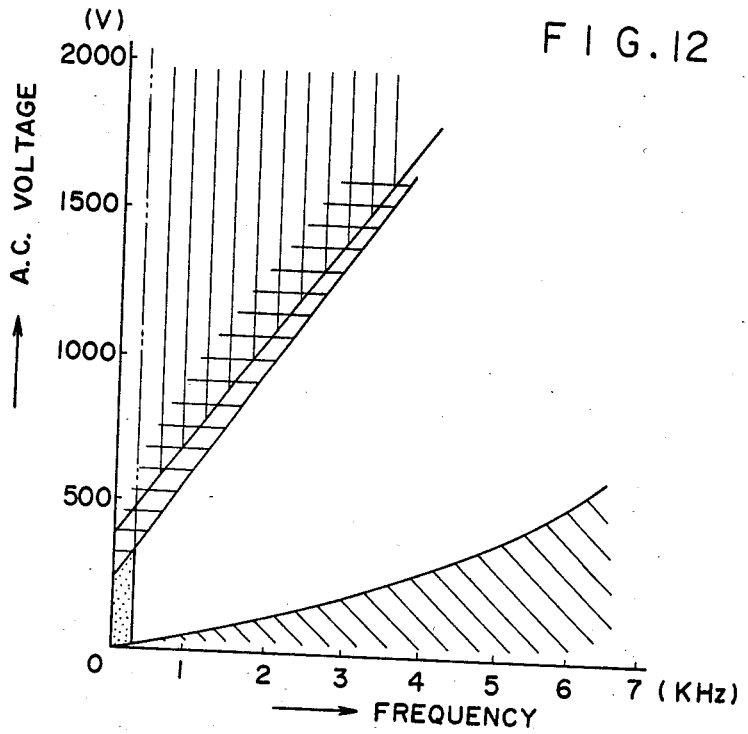
Figure 13:
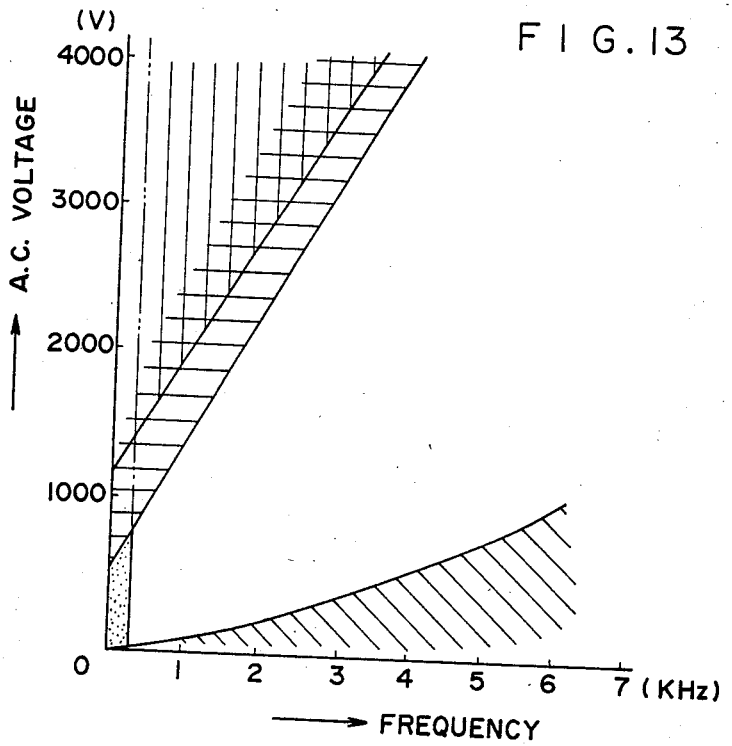

After development was effected under the condition described above, the developed image was transferred to plain paper by corona discharge, and was then passed through a heat roller fixing device having a surface temperature of 140° C. for fixing. The resulting picture on the recording paper had a high density and was extremely clear, but was devoid of any edge effect and fog. The picture was superior to the picture obtained in the Experiment L in its higher resolution and higher density. Subsequently, 50,000 copies were obtained, but the picture remained stable and unaltered from the start to the end. When the frequency and voltage of the A.C. voltage component to be applied to the sleeve 2a were changed in the Experiments described above, the results obtained were shown in FIG. 12 for the Experiment K, and shown in FIG. 13 for the Experiments L and M.

As can be understood clearly from the Experiments described above, the embodiment described above provides the excellent effect that the carrier having an average particle size of below 30 μm and the toner having an average particle size of below 10 μm can be used to provide an excellent and clear reproduced picture devoid of any fog without any practical problems.

Still another embodiment of the present invention effects development using a two-component system developer consisting of toner particles for pressure-fixing and carrier particles under an oscillating electric field, in order to eliminate the problems that the toner particles for pressure-fixing are likely to attach to the carrier particles and are likely to aggregate. Furthermore, this embodiment makes it possible to further reduce the particle sizes of the toner and carrier particles, to facilitate fixing of the toner image to the recording paper and to improve the quality of the reproduced picture.

In the present invention, heretofore known toner particles for pressure-fixing, which can be fixed onto the recording paper when pressed by a line pressure of approximately 20 kg/cm by a press roller for pressure-fixing, are used as the toner particles for pressure-fixing, of the two-component system developer. Such toner particles can be produced by various known methods from the following starting materials. A tinting component such as carbon black and a charge controller, which is added whenever necessary, are added to viscous resins such as polyolefins, ethylene-vinyl acetate copolymers, polyurethanes, rubbers and the like, or to aliphatic wax such as plamitic acid, stearic acid or the like. If the toner is a magnetic toner, fine ferromagnetic or magnetic particles of metals such as iron, chromium, nickel, cobalt and the like, or their compounds or alloys such as triiron tetraoxide, γ-ferric oxide, chromium dioxide, manganese oxide, ferrite, manganese-copper type alloys and the like, are dispersed in the resin. Known toner particles of a micro-capsule type are formed by coating the outside of particles which have the viscosity to the recording paper by a resin having high chargeability (which may contain the tinting component or the like) which is generally used for the toner particles for heat fixing. In the present invention, the spherical dispersed toner particles or microcapsule toner particles having the viscous particles inside of the toner described above by the spray dry method, the flow coater method, the granulation polymerization method, and the like, are used preferably. Incidentally, the sphering treatment in the flow coater method may be effected either using hot water or using hot air.

If the spherical toner particles described above are used, the fluidity of the toner particles is improved, and the problems that the toner particles attach strongly to the carrier particles and the toner particles aggregate one another can be remarkably eliminated. In addition, the charge of the toner particles due to friction with the carrier particles is also improved, so that only the toner particles are selectively attached to the electrostatic latent image from the developer layer formed by the toner particles in cooperation with the carrier particles in a suitable density, and the transfer efficiency from the surface of the image retainer to the recording paper as well as fixability can also be improved.

Such development is effected primarily under the oscillating electric field in the present invention, the aforementioned problems resulting from the use of the toner particles for pressure-fixing as the toner particles of the two-component system developer and the problems resulting from the reduction of the particle size of the toner particles can be solved. In other words, the toner particles attaching to the developer layer are likely to move and peel from the developer layer to the image portions on the surface of the image retainer due to the oscillation applied electrically thereto. If the surface of the image retainer is frictionized by the developer layer, the toner particles attaching to the non-image portions on the surface of the image retainer can be easily moved therefrom or be easily transferred to the electrostatic image portion. If the thickness of the developer layer is smaller than the spacing between the surface of the image retainer and the developer transfer support, the migration of the toner particles having a low charge quantity to the image and non-image portions can be remarkably reduced. Since the toner particles are not brought into frictional contact with the surface of the image retainer, they do not attach to the image retainer due to frictional charge, and the toner particles of about 1 μm can be used. Accordingly, a clear toner image reproducing the electrostatic latent image with a high level of fidelity and reproducibility can be obtained.

Furthermore, since the oscillating electric field weakens the coupling between the toner particles and the carrier particles, the attachment of the carrier particles together with the toner particles can be reduced. The effect of development under the oscillating electric field becomes further remarkable when the spherical toner particles are used as the toner particles. Particularly when the thickness of the developer layer is made smaller than the spacing between the surface of the image retainer and the developer transfer support, the toner particles having a high charge quantity oscillate under the oscillating electric field at the image and non-image portions, and the carrier particles also oscillate depending upon the intensity of the electric field, so that the toner is moved selectively to the electrostatic image portion on the surface of the image retainer, thereby reducing remarkably the deposition of the carrier particles onto the surface of the image retainer.

Experiment N

Non-magnetic particles consisting of 100 parts by weight of an ethylene-vinyl acetate copolymer, 10 parts by weight of carbon black and 5 parts by weight of Nigrosine, sphered by the flow coater method after milling and granulation and having an average particle size of 10 μm were used as the toner particles, while spherical ferrite particles having an average particle size of 30 μm, magnetization of 50 emu/g and a resistivity of about $10^{14}$ Ohm-cm and coated by a styrene-acrylic resin were used as the carrier particles. Development was conducted using the developing apparatus shown in FIG. 1 in such a fashion that the ratio of the toner of the developer D at the developer stay 6 became 10 wt % to the carrier. The average charge quantity of the toner was 15 μC/g.

The image retainer 1 in this case was a CdS photosensitive member, and its peripheral speed was 180 mm/sec. The highest potential of the electrostatic image formed on the image retainer 1 was −500 V. The outer diameter of the sleeve *2a* was 30 mm, and its number of revolution was 100 rpm. The flux density of the N and S poles of the magnet *2b* was 900 Gauss, and the number of revolution was 1,000 rpm. The thickness of the developer layer was 0.6 mm, and the spacing between the sleeve *2a* and the image retainer 1 was 0.5 mm, that is, 500 μm. The bias voltage to be applied to the sleeve *2a* was −250 V D.C. voltage component and 1.5 KHz, 500 V A.C. voltage component.

After development was effected under the condition described above, the developed image was transferred to plain paper using a corona discharger, and was then passed through a pressure fixing device used for a calendar roller at a force of pressurization of 20 Kg/cm line pressure for fixing. The resulting toner image on the recording paper had high fixability and high density, was extremely clear but was devoid of any edge effect and fog. Subsequently, 50,000 copies were obtained, but the picture remained stable and unaltered from the start to the end.

Experiment O

The non-magnetic particles which were the same as those used in Experiment N except that the average particle size was 5 μm, were used as the toner particles. Sphered ferrite particles which were produced by dispersing 50 wt % of fine ferrite particles having an average particle size of 0.2 μm in the same resin as used for the toner, then kneading and milling the mixture and thereafter subjecting to the sphering treatment by hot air, and which had an average particle size of 20 μm, magnetization of 30 emu/g and a resistivity of at least $10^{14}$ Ohm-cm, were used as the carrier particles. Development was conducted using the apparatus shown in FIG. 3 in such a fashion that the ratio of the toner of the developer D at the developer stay 6 became 5 wt % to the carrier. The average charge quantity of the toner was 30 μC/g.

The condition of the image retainer 1 in this case was the same as Experiment N. The outer diameter of the sleeve 2a was 30 mm, but its number of revolution was 150 rpm. The flux density of the pole of the magnet 2b opposing the developing zone A was 1,200 Gauss. The thickness of the developer layer was 0.6 mm, and the spacing between the sleeve 2a and the image retainer 1 was 0.7 mm, that is, 700 μm. The bias voltage to be applied to the sleeve 2a was −200 V D.C. voltage component and 2 KHz, 1,000 V A.C. voltage component.

After development was effected under the condition described above, the developed image was transferred to plain paper by corona discharge and was then fixed under the same condition as in Experiment N. The resulting picture on the recording paper had high fixability and high density and was extremely clear, but was devoid of any edge effect and fog. Subsequently, 50,000 copies were obtained, but the picture remained stable and unaltered from the start to the end.

Experiment P

Development was conducted using the same toner and carrier as those in Experiment O and the same developing apparatus as shown in FIG. 1 (except that the spacing between the image retainer 1 and the developer transfer support was different), in such a fashion that the ratio of the toner of the developer D at the developer stay 6 became 5 wt % to the carrier. The average charge quantity of the toner was 30 μC/g.

The condition of the image retainer 1 in this case was the same as that in Experiment N. The outer diameter of the sleeve 2a was 30 mm, but its number of revolution was 100 rpm. The flux density of the N and S poles was 700 Gauss, and the number of revolution was 500 rpm. The thickness of the developer layer was 0.6 mm, and the spacing between the sleeve 2a and the image retainer 1 was 0.7 mm, that is, 700 μm. The bias voltage to be applied to the sleeve 2a was −200 V D.C. voltage component and 2 KHz, 1,000 V A.C. voltage component.

After development was effected under the condition described above, the developed image was transferred to plain paper by corona discharge and was then fixed under the same condition as in Experiment N. The resulting picture on the recording paper had high fixability and high density and was extremely clear but was devoid of any edge effect and fog. The picture was superior to the picture obtained in Experiment O in its higher resolution and higher density. Subsequently, 50,000 copies were obtained, but the picture remained stable from the start to the end.

Figure 14:
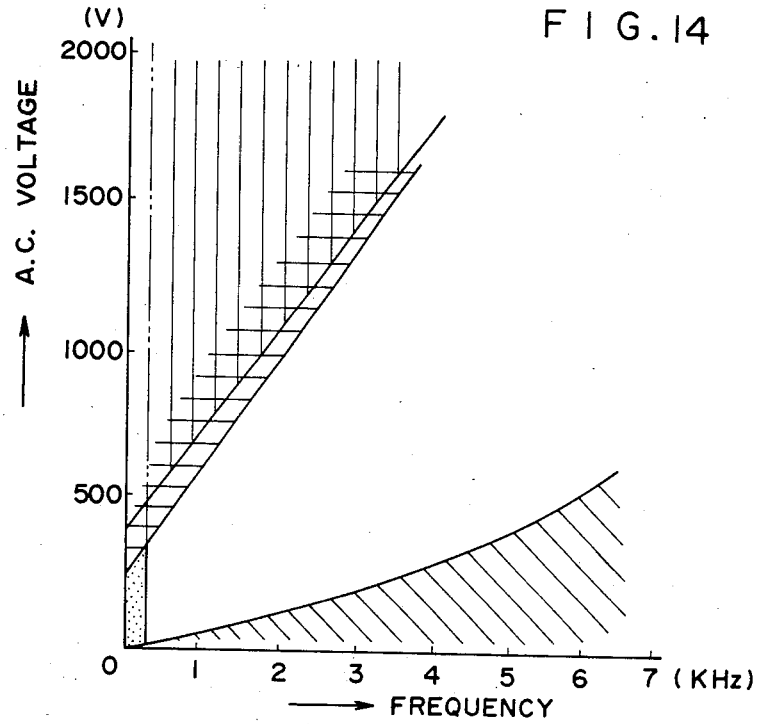
Figure 15:
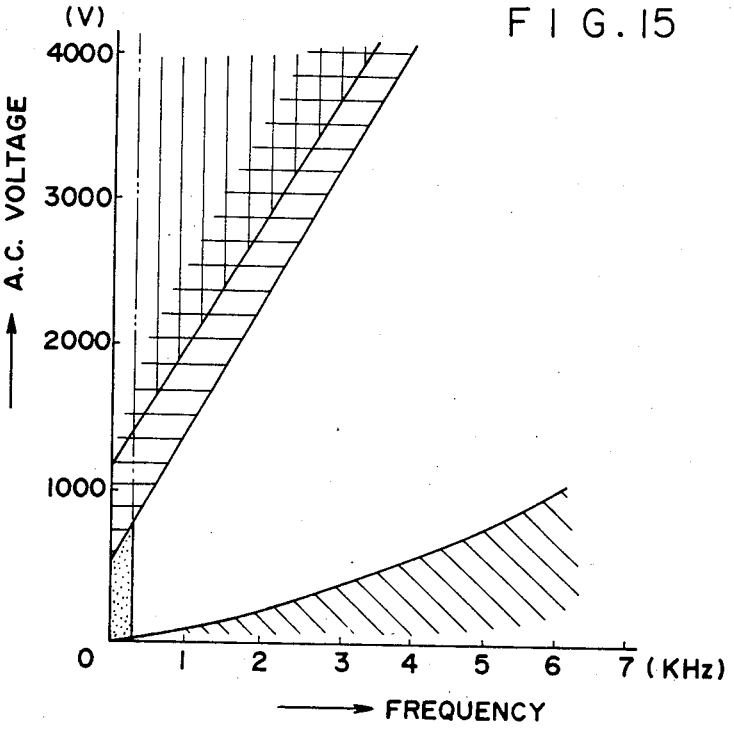

When the frequency and voltage of the A.C. voltage component to be applied to the sleeve 2a were changed in the Experiments described above, the results were shown in FIG. 14 for the Experiment N, and shown in FIG. 15 for the Experiments O and P.

According to this embodiment of the invention, since development is effected while applying the action of the oscillating electric field to the developer layer of the two-component system developer inside the developing zone, the toner for pressure-fixing can be used as the toner, and hence fixing of the toner image to the recording paper can be carried out more easily than the conventional developing methods In addition, there can be provided the effect that a reproduced picture devoid of fog but excellent in its clearness can be obtained.

Figure 16:
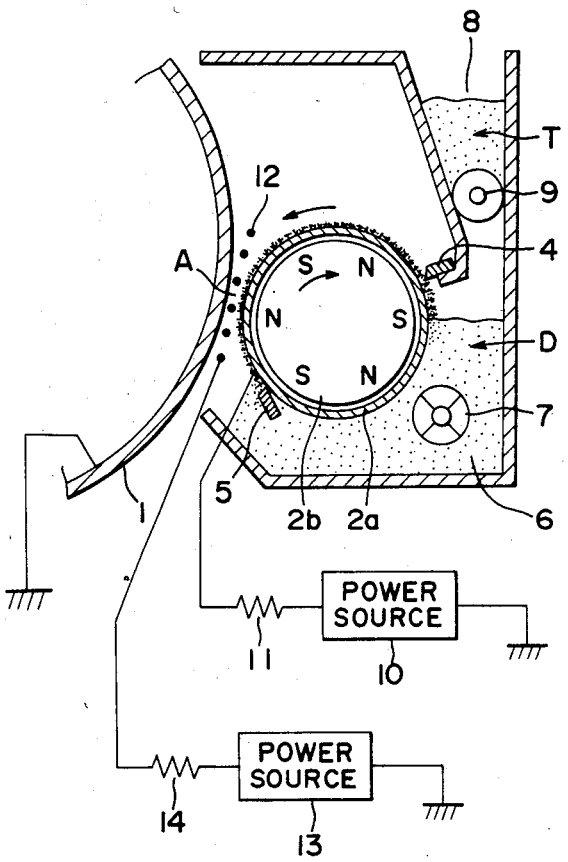
Figure 17:
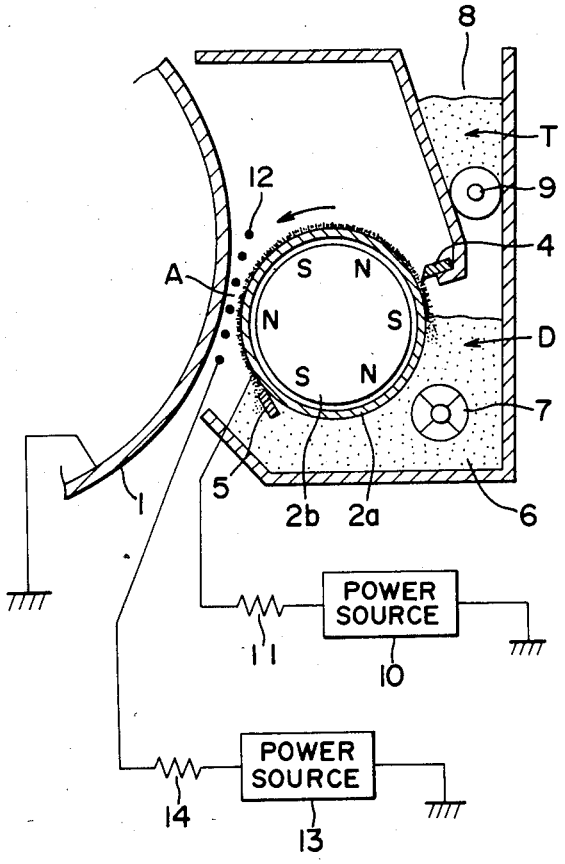
Figure 18:
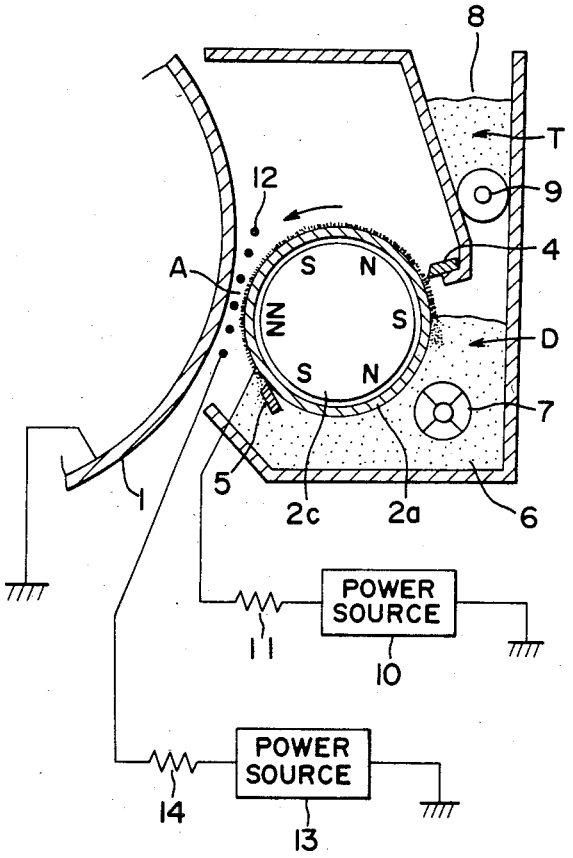

FIGS. 16 to 18 each show the developing apparatus of the another embodiments of the present invention.

Numeral 1 denotes a drum-like image retainer having an electrophotographic photosensitive layer or dielectric layer on which an electrostatic latent image is formed by an electrostatic latent image forming apparatus using conventional charge and exposure device or multi-stylus electrode or ion control electrode (not shown), 2a denotes a sleeve made of Al, and the like, and 2b or 2c denotes a magnet roller equipped with a plurality of magnetic poles N, S in its circumferential direction and arranged inside the sleeve 2a.

The sleeve 2a and the magnet roller 2b or 2c form a developer transfer support and are rotatable relative to each other. FIG. 16 shows the magnet roller rotated in the clockwise direction, whereas the sleeve 2a is rotated in the counter-clockwise direction. The magnetic poles N, S of the magnet roller are generally magnetized to a flux density of between 500 and 1500 Gauss.

A so-called magnetic brush is formed by attaching on the surface of the sleeve 2aa layer of developer D consisting of toner particles and carrier particles by the magnetic flux. The magnetic brush is moved in a direction same with that of the sleeve 2a by the above rotation of the sleeve 2a and the magnet roller 2b and is fed to a developing region A.

Number 4 denotes a regulation blade formed by a magnetic member or non-magnetic member for regulating the height or quantity of the magnetic brush on the surface of the sleeve 2a, 5 denotes a cleaning blade for removing the magnetic brush having been passed through the developing region A from the sleeve 2a, 6 denotes a developer stay, 7 denotes an agitation screw for making uniform the proportion between the toner particles and the carrier particles by stirring the developer D inside the developer stay 6, 8 denotes a toner hopper for supplementing the toner particles T, and 9 denotes a feed roller having on the surface thereof recesses for supplying the toner particles T on the developer stay 6. In the developer stay 6 a two-component developer consisting of the toner particles and the carrier particles is filled.

The above-mentioned developing apparatus is substantially similar in construction to the conventional developing apparatus for use in the developing method using the two-component developer. In an apparatus shown in FIG. 16 each of the flux density of N, S poles of the magnet roller 2b is the same with one another and the magnet roller 2b is rotated in a direction contrary to that of the sleeve 2a. An apparatus shown in FIG. 17 differs from that shown in FIG. 16 in the point that the magnet roller is not rotated. In an apparatus shown in FIG. 18, each of the flux density of N, S poles of the magnet roller 2c is not the same with one another. Specifically, the apparatus shown in FIG. 18 differs from that shown in FIG. 17 in the point that the flux density of the magnetic pole opposing the image retainer 1 is kept different from the other flux density of the magnetic pole, and two N poles are arranged in side-by-side relationship to form a repellent magnetic field therebetween.

To further increase the flux density of the pole opposing the image retainer 1, N pole and S pole may be brought close to each other, instead of two poles of the same polarity are brought close to each other as shown in FIG. 18. By such an arrangement that a plurality of magnetic poles are brought close the stable development can be achieved.

In the developing method in accordance with aforesaid embodiments of the invention, the spacing between the sleeve 2a and the blade 5 for regulating the thickness of the developer layer and the spacing between the sleeve 2a and the image retainer 1 are adjusted so that the magnetic brush formed on the sleeve 2a does not come into contact with the surface of the image retainer 1, and a control electrode 12 which does not prevent by itself the toner particles from projecting from the magnetic brush to the image retainer 1, such as a wire stretched in parallel with the axial direction of the sleeve 2a, is disposed, so that a voltage having an A.C. voltage component is applied either to this control electrode 12 or to the sleeve 2a to form the oscillating electric field inside the developing zone A and development is effected under this oscillating electric field by the magnetic brush, as shown in FIG. 16. In the drawing, reference numeral 13 represents a power source for applying the voltage to the sleeve 2a and reference numeral 14 represents a protective resistor.

The control electrode 12 is stretched preferably in the spacing between the magnetic brush and the image retainer 1 so that the spacing between the sleeve 2a and the control electrode is at least dozens of microns, the spacing between the control electrode 12 and the image retainer 1 is also at least dozens of microns and the spacing between the sleeve 2a and the image retainer 1 is up to two thousands of microns. If the spacing between the sleeve 2a and the control electrode 12 is smaller than dozens of microns, it becomes difficult to form a uniform ear of the magnetic brush and the toner particles can not be supplied sufficiently to the developing unit, so that development can not be effected stably. If the spacing between the control electrode 12 and the image retainer 1 is smaller than dozens of microns, discharge is likely to occur. If the spacing between the sleeve 2a and the image retainer 1 is greater than two thousands of microns, the electrode effect of the sleeve 2a drops, a sufficient development density can not be obtained and the edge effect becomes more remarkable. Incidentally, the control electrode 12 is preferably constituted by stretching 100 to 1,000 $\mu$m thick wires in the gaps of 0.5 to 5 mm in parallel with one another. Similarly, a mesh having 0.5 to 5 mm lattice holes can also be used. Such a control electrode 12 has the excellent features that it applies a sufficient control effect to the toner particles projecting from the magnetic brush to the electrostatic image of the image retainer 1, seldom prevents the projection of the toner particles and can remove the toner particles therefrom even if the toner particles attach thereto.

Development under the oscillating electric field is effected by applying the voltage having an A.C. voltage component to the control electrode 12 arranged in the manner described above or to the sleeve 2a, in the following way.

(1) The voltage having an A.C. component is applied only to the control electrode 12. It is preferred in this case to apply an A.C. voltage of 200 to 4,000 V having a frequency of 100 Hz to 10 KHz, preferably 1 KHz to 5 KHz and more preferably, the A.C. voltage described above which is superposed with a D.C. voltage of up to 600 V, to the control electrode 12 and a D.C. voltage of up to 600 V to the sleeve 2a. The D.C. voltage to be applied to the sleeve 2a is preferably set to a higher potential than the potential at the non-image portion of the image retainer 1 in order to prevent the fog of the toner.

(2) The voltage having an A.C. component is applied to both control electrode 12 and sleeve 2a. If the same frequency is used for both A.C. components in this case, it is generally preferred to apply a higher A.C. voltage to the sleeve 2a than to the control electrode 12. If different frequencies are used, on the other hand, one is different from the other by some multiples in order to prevent the occurrence of the beat of the electric field. The A.C. component voltage having a higher frequency is preferably applied to the sleeve 2a because the uniform cloud of the toner particles is likely to occur between it and the control electrode 12. The magnitude of the A.C. voltage component to be applied to the sleeve 2a is preferably greater than that to be applied to the control electrode 12. It is further preferred to superpose and apply a D.C. voltage of up to 600 V to the sleeve 2a and to the control electrode 12. This D.C. voltage, which is to be applied to the sleeve 2a, is also preferably set to a higher level than the potential of the non-image portion of the image retainer 1 in order to prevent the fog of the toner. In this case, too, the frequency and voltage values of the A.C. component is preferably within the same range as described in the item (1) above.

(3) The voltage having an A.C. component is applied only to the sleeve 2a. In this case, an A.C. voltage of 200 to 4,000 V having a frequency of 100 Hz to 10 KHz, preferably from 1 KHz to 5 KHz, is applied to the sleeve 2a. More preferably, the A.C. voltage described above is superposed with a D.C. voltage of up to 600 V. A D.C. voltage of up to 600 V is preferably applied also to the control electrode 12. In this case, too, the D.C. voltage of the sleeve 2a is set to a higher level than the potential of the non-image portion of the image retainer 1 in order to prevent the fog of the toner.

The A.C. component may be a rectangular or triangular wave besides a sine wave. Though somehow associated with the frequency, the higher the voltage, the more vigorously is oscillated the magnetic brush of the developer, so that the separation and projection of the toner particles from the carrier particles become easier. On the contrary, dielectric breakdown and toner adherence at the background, which appears as fog on the recording paper is more likely to occur. The occurrence of fog ca be prevented by the D.C. voltage component. The dielectric breakdown can also be prevented by coating insulatingly or semi-insulatingly the surfaces of the control electrode 12 and sleeve 2a by a resin or oxide coating film, or using insulating carrier particles such as those to be next described as the carrier particles of the developer.

In the developing method of this embodiment of the present invention, the magnetic brush of the two-component developer is kept out of contact with the image retainer 1 and the control electrode 12 is disposed between them so as to carry out development by the magnetic brush under the oscillating electric field. According to this method, the separability and projecting property of the toner particles from the magnetic brush can be improved, deposition of the carrier particles onto the image retainer 1 can be prevented, and hence the toner and carrier particles in the fine powder form can be used. Thus, this embodiment enables the development of a high quality picture.

As described above in detail, in the development method of this embodiment of the invention, the ear of the magnetic brush is kept out of contact with the image retainer, the control electrode is disposed between them and development is effected under the oscillating electric field. Accordingly, the advantage of the two-component developer consisting of fine toner and carrier particles can be fully exhibited, and a clear and quality picture can be obtained.

Experiment Q

Resin-coated spherical ferrite particles having an average particle size of 30 μm, magnetization of 50 emu/g and a resistivity of at least $10^{14}$ Ohm-cm were used as the carrier. Non-magnetic particles consisting of 100 parts by weight of a styrene-acrylic resin ("Himer UP 110", produced by Sanyo Kasei K.K.), 10 parts by weight of carbon black ("MA-100", produced by Mitsubishi Kasei K.K.) and 5 parts by weight of Nigrosine, having an average particle size of 10 μm and obtained by milling and granulation were used as the toner. Development was conducted using the apparatus shown in FIG. 16 in such a fashion that the ratio of the toner particles of the developer D at the developer stay 6 becomes 10 wt % to the carrier particles. The average charge quantity of the toner was 15 μC/g.

The image retainer 1 in this case was a CdS photosensitive member, and its peripheral speed was 180 mm/sec. The highest potential of the electrostatic image formed on the image retainer 1 was −500 V, and the potential of the non-image portion was −100 V. The outer diameter of the sleeve 2a was 30 mm, and its number of revolution was 100 rpm. The flux density of the N and S poles of the magnetic 2a was 900 Gauss, and the number of revolution was 1,000 rpm. The thickness of the developer layer was 0.4 mm, and the spacing between the sleeve 2a and the image retainer 1 was 1.5 mm, that is, 1,500 μm. The stretching position of the control electrode 12 from the surface of the image retainer 1 was 0.5 mm. A superposed voltage of −200 V D.C. voltage and 1.5 KHz 1,000 V A.C. voltage was applied to the control electrode 12, and −250 V D.C. voltage was applied to the sleeve 2a. A wire having a diameter of 0.2 mm was stretched with 1 mm pitches in parallel with the sleeve 2a to form the control electrode 12.

After development was effected under the condition described above, the developed image was transferred to plain paper by a corona discharger, and was then passed through a heat roller fixing device having a surface temperature of 140° C. for fixing. The resulting picture on the recording paper had a high density and was extremely clear, but was devoid of any edge effect and fog. Subsequently, 50,000 copies were obtained, but the picture remained stable and unaltered from the start to the end.

Experiment R

Magnetic particles produced by dispersing 50 wt % of fine ferrite in a resin, having an average particle size of 20 μm, magnetization of 30 emu/g and a resistivity of at least $10^{14}$ Ohm-cm and subjected to the sphering treatment by heating were used as the carrier particles, while non-magnetic particles having an average particle size of 5 μm were used as the toner particles. Development was conducted using the apparatus shown in FIG. 17 in such a fashion that the ratio of the toner particles of the developer D at the developer stay 6 became 5 wt % to the carrier particles. The average charge quantity of the toner was 30 μC/g.

The condition of the image retainer 1 in this case was the same as in Experiment Q. The outer diameter of the sleeve 2a was 30 mm, but its number of revolution was 150 rpm. The flux density of the pole of the magnet 2b opposing the developing zone A was 1,200 Gauss. The thickness of the developer layer was 0.5 mm, and the spacing between the sleeve 2a and the image retainer 1 was 1.0 mm, that is, 1,000 μm. The control electrode 12 had a mesh structure such that wires of a 50 μm diameter were stretched slantingly with respect to the axial direction of the sleeve 2a and crossed one another to form 1 mm lattice holes. This control electrode 12 was disposed at a position 0.3 mm distant from the surface of the image retainer 1. A bias voltage having an A.C. voltage component of 300 Hz and 700 V was applied to the control electrode 12, and a bias voltage having a D.C. voltage component of −200 V was applied to the sleeve 2a.

After development was effected under the condition described above, the developed image was transferred and fixed to the plain paper in the same way as in Experiment Q. The resulting picture of the recording paper had a high density and was extremely clear, but was devoid of any edge effect and fog. Subsequently, 50,000 copies were obtained, but the picture remained stable and unaltered from the start to the end.

Experiment S

Development, transfer and fixing were conducted in the same way as in Experiment Q except that the stretching pitch of the wire of the control electrode 12 was 2 mm, the A.V. voltage component of the superposed voltage applied to the control electrode 12 was 300 KHz, 500 V, and 2 KHz, 1,000 V A.C. voltage was applied to the sleeve 2a in addition to the D.C. voltage. The resulting picture on the recording paper was clear in the same way as in Experiment Q, and remained stable and unaltered even after reproduction of 50,000 copies.

Experiment T

Development, transfer and fixing were conducted in the same way as Experiment R except that the wires of the control electrode 12 crossed one another to define 2 mm lattice holes, and that 2 KHz, 400 V A.C. voltage component was applied to the sleeve 2a in addition to the D.C. component. The resulting picture on the recording paper was clear in the same way as the picture obtained in Experiment R. Even after 50,000 copies were obtained, the picture remained stable and unaltered from the start to the end.

Experiment U

Development, transfer and fixing were conducted in the same way as Experiment S except that −150 V D.C. voltage was applied to the control electrode 12 and that a superposed voltage of −250 V D.C. voltage and 1.5 KHz, 2,000 V A.C. voltage was applied to the sleeve 2a. The resulting picture on the recording paper was the same as those in Experiments Q and S.

Experiment V

Development, transfer and fixing were conducted in the same way as Experiment T except that −200 V D.C. voltage was applied to the control electrode 12 and that a superposed voltage of −200 V D.C. voltage and 1 KHz, 800 V A.C. voltage was applied to the sleeve 2*a*. The same result as those of Experiments R and T could be obtained.

When a two-component system developer is used in the conventional magnetic brush developing method, the particle sizes of the toner and carrier particles can not be much reduced, so that a reproduced picture having high quality can not be obtained.

In accordance with the developing method of this embodiment of the invention, however, the control electrode for forming the oscillating electric field inside the developing zone and controlling the field is disposed so as to let the toner particles form the cloud inside the oscillating electric field. Accordingly, the toner having an average particle size of 1 to 20 μm and the carrier having an average particle size of 4 to 50 μm, preferably 5 to 50 μm can be used, and a reproduced picture having a sufficient density and high tone and resolution can be obtained.

Since the developer is of the two component system (or two or more components may also be used), the charge of the toner can be more stabilized than the toner of a single component system, and the aggregation of the toner is difficult to occur.

What is claimed is:

1. A developing method comprising the steps of supplying a developer having magnetic carrier particles and toner particles on a developer feeding carrier to form a developer layer, the average particle size of the carrier particles being from 5 to 50 μm, and the average particle size of the toner particles being up to 20 μm, conveying the developer layer into an oscillating electric field, and developing a latent image on an image retainer by the developer inside the oscillating electric field, the thickness of said developer layer being smaller than the distance between the developer feeding carrier and the image retainer.

2. A developing method according to claim 1 wherein the carrier particle is sphered.

3. A developing method according to claim 1 wherein the toner particle is sphered.

4. A developing method according to claim 1 wherein the carrier particles comprise magnetic particles and a thermoplastic resin.

5. A developing method according to claim 1 wherein the toner particle is a toner for pressure-fixing.

6. A developing method according to claim 1 wherein the developer feeding carrier has a rotary magnet therein.

7. A developing method according to claim 1 wherein the frequency of the oscillating electric field is 100 Hz–10 KHz.

8. A developing method according to claim 1 wherein the frequency of the oscillating electric field is preferably 1 KHz–5 KHz.

9. A developing method according to claim 1 wherein the toner particle is magnetic.

10. A developing method according to claim 1 wherein the toner particle is non-magnetic.

11. A developing method according to claim 1 wherein the carrier particle is made of magnetic particles and insulating material of more than $10^8$ Ohm-cm electric resistivity.

12. A developing method according to claim 1 wherein the carrier particle is sphered, and the carrier particles comprise magnetic particles and a thermoplastic resin.

13. A developing method comprising the steps of supplying a developer having magnetic carrier particles and toner particles on a developer feeding carrier to form a developer layer, conveying the developing layer into an oscillating electric field provided by a control electrode for controlling the fly of the toner particles in a developing region between the developer feeding carrier and the image retainer, and developing a latent image on an image retainer by the developer inside the oscillating electric field.

14. A developing method comprising the steps of supplying a developer having magnetic carrier particles and toner particles on a developer feeding carrier to form a developer layer, conveying the developer layer into an oscillating electric field, and developing a latent image on an image retainer by the developer inside the oscillating electric field, the thickness of said developer layer being smaller than the distance between the developer feeding carrier and the image retainer, said developing being carried out in said oscillating electric field so that only toner particles among carrier particles and toner particles are oscillated and carrier particles do not contact said image retainer.

15. A developing method according to claim 14 wherein the frequency of the oscillating electric field is preferably 1 KHz–5 KHz.

16. A developing method according to claim 14 wherein the average particle size of the carrier particles is from 4 to 50 μm.

17. A developing method according to claim 14 wherein the average particle size of the toner particles is up to 20 μm.

* * * * *